US009550386B2

(12) United States Patent
Yokota

(10) Patent No.: US 9,550,386 B2
(45) Date of Patent: Jan. 24, 2017

(54) LIQUID DISCHARGING APPARATUS AND LIQUID DISCHARGE POSITION ADJUSTMENT METHOD

(71) Applicant: SEIKO EPSON CORPORATION, Tokyo (JP)

(72) Inventor: So Yokota, Shiojiri (JP)

(73) Assignee: Seiko Epson Coporation, Tokyo (JP)

( * ) Notice: Subject to any disclaimer, the term of this patent is extended or adjusted under 35 U.S.C. 154(b) by 0 days.

(21) Appl. No.: 14/868,907

(22) Filed: Sep. 29, 2015

(65) Prior Publication Data

US 2016/0089918 A1 Mar. 31, 2016

(30) Foreign Application Priority Data

Sep. 30, 2014 (JP) ..... 2014-200980

(51) Int. Cl.

| | |
|---|---|
| ***B41J 29/393*** | (2006.01) |
| ***B41J 19/14*** | (2006.01) |
| *B41J 2/51* | (2006.01) |
| *B41J 2/045* | (2006.01) |
| *B41J 2/21* | (2006.01) |

(52) U.S. Cl.

CPC ..... *B41J 29/393* (2013.01); *B41J 2/04526* (2013.01); *B41J 19/145* (2013.01); *B41J 2/04505* (2013.01); *B41J 2/2135* (2013.01); *B41J 2/512* (2013.01)

(58) Field of Classification Search

None

See application file for complete search history.

(56) References Cited

U.S. PATENT DOCUMENTS

2013/0286075 A1* 10/2013 Tamiya ..... B41J 13/26 347/16

FOREIGN PATENT DOCUMENTS

JP 2001-129980 5/2001

* cited by examiner

*Primary Examiner* — Lisa M Solomon

(74) *Attorney, Agent, or Firm* — Foley & Lardner LLP

(57) ABSTRACT

A liquid discharging apparatus includes a discharging unit that includes a nozzle row that discharges a liquid, and that is able to reciprocate in a first direction that intersects the nozzle row; a transport unit that transports a medium in a second direction that intersects the first direction; and a reading unit that reads the liquid discharged from the discharging unit to the medium. The liquid discharging apparatus is configured to execute an adjustment pattern forming operation for forming a first adjustment pattern for adjusting a landing position of the liquid discharged from the discharging unit in the first direction and a second adjustment pattern for adjusting the landing position of the liquid discharged from the discharging unit in the second direction on the medium, and an adjustment pattern reading operation for reading the first and second adjustment pattern with the reading unit according to a single command.

14 Claims, 17 Drawing Sheets

LIQUID DISCHARGING APPARATUS AND LIQUID DISCHARGE POSITION ADJUSTMENT METHOD

BACKGROUND

1. Technical Field

The present invention relates to a liquid discharging apparatus and a liquid discharge position adjustment method.

2. Related Art

In the related art, liquid discharging apparatuses, such as a recording apparatus that discharges a liquid, such as ink, on a medium, such as a recording medium, are used. In such a liquid discharging apparatus, adjusting the position at which the liquid lands on the medium is generally performed before discharging the liquid to the medium.

For example, JP-A-2001-129980 discloses a recording apparatus that transports a recording medium and performs recording by discharging ink to the recording medium by a recording head being reciprocated in a direction that intersects a transport direction of the recording medium, in which the recording apparatus is able to form an adjustment pattern for adjusting the landing position of the ink in the reciprocation direction of the recording head and the transport direction of the recording medium.

However, it takes time to individually form various adjustment patterns. Generally, this is because a maintenance operation for the discharging unit is executed, in order for ink (liquid) to be appropriately discharged before and after forming (recording) each adjustment pattern. Therefore, in the related art, a long time is taken in adjusting the position at which the liquid lands on the medium.

SUMMARY

An advantage of some aspects of the invention is to shorten the time for adjusting the position of a liquid landing on a medium in a liquid discharging apparatus that discharges the liquid on the medium.

According to a first aspect of the invention, there is provided A liquid discharging apparatus, including: a discharging unit that includes a nozzle row that discharges a liquid, and that is able to reciprocate in a first direction that intersects the nozzle row; a transport unit that transports a medium in a second direction that intersects the first direction; and a reading unit that reads a pattern formed by the liquid discharged from the discharging unit to the medium, in which the liquid discharging apparatus is configured to be able to continuously execute a first adjustment pattern forming operation for forming an adjustment pattern of one of a first adjustment pattern for adjusting a landing position of the liquid discharged from the discharging unit in the first direction or a second adjustment pattern for adjusting the landing position of the liquid discharged from the discharging unit in the second direction is formed on the medium, a first adjustment pattern reading operation for reading the one adjustment pattern formed in the first adjustment pattern forming operation with the reading unit, a second adjustment pattern forming operation for forming the other adjustment pattern different to the adjustment pattern formed in the first adjustment pattern forming operation on the medium, and a second adjustment pattern reading operation for reading the other adjustment pattern formed in the second adjustment pattern forming operation with the reading unit.

According to a second aspect of the invention, in the liquid discharging apparatus of the first aspect, the other adjustment pattern is formed after adjustment according to reading results of the one adjustment pattern.

According to a third aspect of the invention, in the liquid discharging apparatus of the first or second aspect, in the first and second adjustment pattern forming operations, the first adjustment pattern and the second adjustment pattern are formed lined up in the first direction.

According to a fourth aspect of the invention, in the liquid discharging apparatus of any one of the first to third aspects, the second adjustment pattern is formed and the second adjustment pattern is read by the reading unit after the first adjustment pattern is formed and the first adjustment pattern is read by the reading unit.

According to a fifth aspect of the invention, in the liquid discharging apparatus of the fourth aspect, the medium is transported by a predetermined amount from forming the first adjustment pattern until the second adjustment pattern is formed.

According to a sixth aspect of the invention, in the liquid discharging apparatus of any one of the first to third aspects, the first adjustment pattern is formed and the first adjustment pattern is read by the reading unit after the second adjustment pattern is formed and the second adjustment pattern is read by the reading unit.

According to a seventh aspect of the invention, the liquid discharging apparatus of any one of the first to sixth aspects further includes an adjustment unit for adjusting the landing position of the liquid, based on the reading results of the first adjustment pattern and the second adjustment pattern by the reading unit.

According to an eighth aspect of the invention, in the liquid discharging apparatus of any one of the first to seventh aspects, the first adjustment pattern is formed from a plurality of reference patterns, and has an adjustment pattern that is able to adjust the discharge timing of the liquid by the liquid being discharged with the discharge timing of the liquid shifted with respect to the plurality of reference patterns.

According to a ninth aspect of the invention, in the liquid discharging apparatus of any one of the first to eighth aspects, the reading unit is able to read a plurality of locations corresponding to different regions from the nozzle row in the first adjustment pattern.

According to a tenth aspect of the invention, in the liquid discharging apparatus of the ninth aspect, the nozzle row is able to discharge liquid droplets with different discharge amounts, and the first adjustment pattern is formed so that an outside region has droplets with a smaller discharge amount than the inside region among the different regions.

According to an eleventh aspect of the invention, in the liquid discharging apparatus of any one of the first to tenth aspects, the first adjustment pattern is formed by the discharging unit being reciprocated a plurality of times in the first direction.

According to a twelfth aspect of the invention, there is provided a liquid discharge position adjustment method that is executable using a liquid discharging apparatus provided with a discharging unit that includes a nozzle row that discharges a liquid and that is able to reciprocate in a first direction that intersects the nozzle row, a transport unit that transports a medium in a second direction that intersects the first direction, and a reading unit that reads a pattern formed by the liquid discharged from the discharging unit to the medium, the method including: continuously executing a first adjustment pattern forming operation for forming an adjustment pattern of one of a first adjustment pattern for adjusting a landing position of the liquid discharged from the discharging unit in the first direction or a second adjustment pattern for adjusting the landing position of the liquid discharged from the discharging unit in the second direction is formed on the medium, a first adjustment pattern reading operation for reading the one adjustment pattern formed in the first adjustment pattern forming operation with the reading unit, a second adjustment pattern forming operation for forming the other adjustment pattern different to the adjustment pattern formed in the first adjustment pattern forming operation on the medium, and a second adjustment pattern reading operation for reading the other adjustment pattern formed in the second adjustment pattern forming operation with the reading unit.

According to the invention, a recording apparatus that performs recording by discharging ink may shorten the time for adjusting the position of ink landing on a recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

The recording apparatus will be described in detail as a liquid discharging apparatus according to an embodiment of the invention with reference to the attached drawings.

Firstly, an outline of the recording apparatus according to an embodiment of the invention is described.

Figure 1:
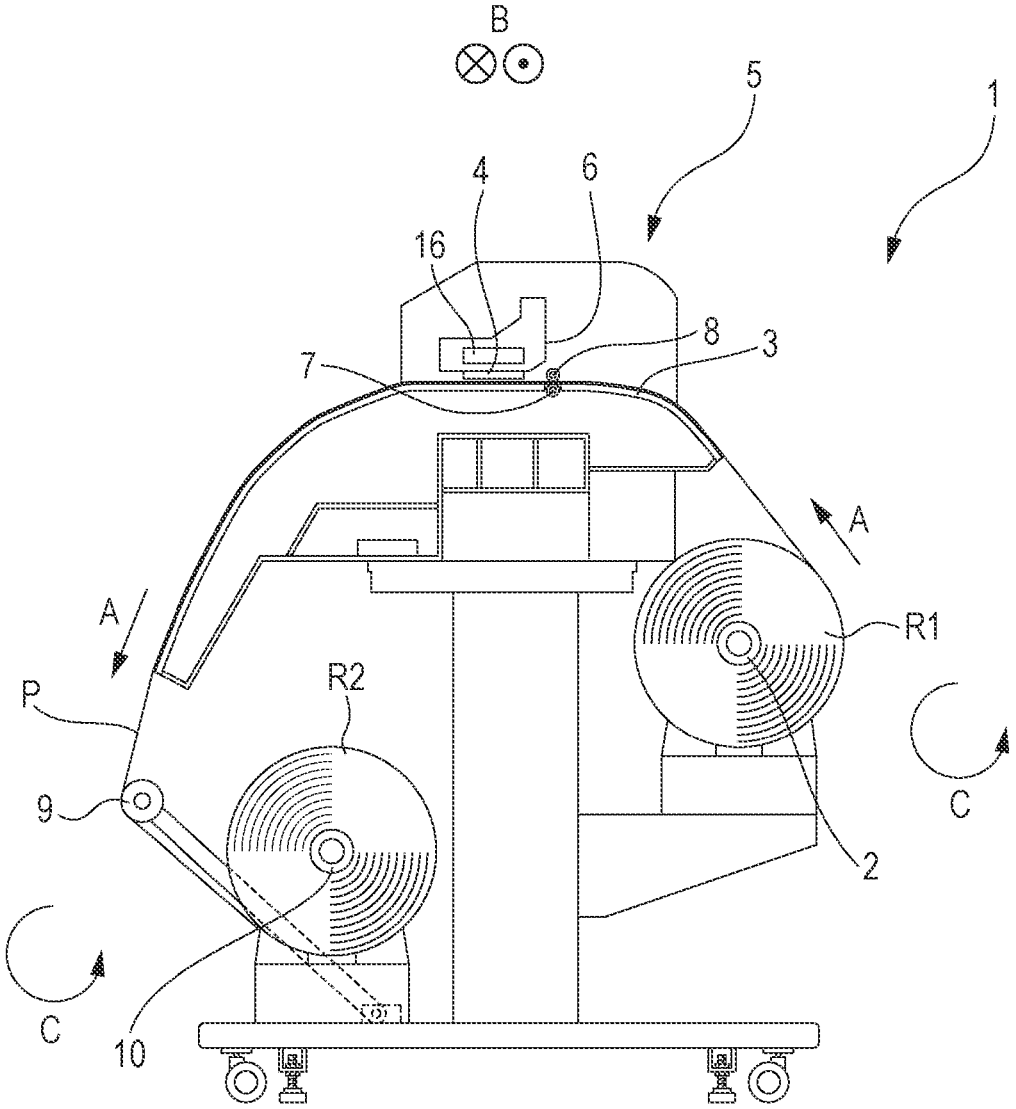
FIG. 1 is a schematic side view showing a recording apparatus according to an embodiment of the invention.

FIG. 1 is a schematic side view of the recording apparatus 1 according to the embodiment.

The recording apparatus 1 of the embodiment includes a support shaft 2 that supports a roll R1 of the roll-like recording medium (medium) P for performing recording. The support shaft 2 rotates in the rotation direction C, when the recording apparatus 1 of the embodiment transports the recording medium P in the transport direction A. In the embodiment, although the roll-type recording medium P wound so that the recording surface becomes the outside is used, sending out the roll R1 by reversely rotating to the rotation direction C of the support shaft 2 in a case of using the roll-type recording medium P wound so that the recording surface becomes the inside is also possible.

Although the recording apparatus 1 of the embodiment uses the roll-type recording medium as the recording medium P, there is no limitation to a recording apparatus using such a roll-type recording medium. For example, a cutform-type recording medium may be used.

The recording apparatus 1 of the embodiment is provided with a transport roller pair 5 made of a driving roller 7 and a driven roller 8 as a transport unit for transporting the recording medium P in the transport direction A.

In the recording apparatus 1 of the embodiment, the driving roller 7 is configured by one roller extending in the direction B that intersects the transport direction A of the recording medium P, and a plurality of driven rollers 8 is provided lined up in the direction B at positions facing the driving roller 7.

A heater, not shown, able to heat the recording medium P supported on a medium support unit 3 is provided on the lower part of the medium support unit 3. In this way, although the recording apparatus 1 of the embodiment is provided with a heater able to heat the recording medium P from the medium support unit 3 side, the recording apparatus may be provided with an infrared ray heater provided at a position facing the medium support unit 3. In the case of using an infrared ray heater, the preferable wavelength of the infrared rays is 0.76 μm to 1000 μm. Generally, the infrared rays are further divided into near-infrared rays, mid-infrared rays, and far-infrared rays according to the wavelength, and although there are various definitions of the division, approximate wavelength regions are 0.78 μm to 2.5 μm, 2.5 μm to 4.0 μm, and 4.0 μm to 1000 μm. Among these, it is preferable to use the mid-infrared rays.

The recording apparatus 1 of the embodiment is provided with a recording head 4 as a recording unit that performs recording by discharging ink from the nozzles of a nozzle forming surface in which a plurality of nozzles is provided, and a carriage 6 mounted to the recording head 4 and able to reciprocate in the direction B.

A sensor 16 is provided as a reading unit that reads the ink discharged from the recording head 4 to the recording medium P in the carriage 6, and is able to read in the entire width direction of the recording medium P corresponding to the direction B through the carriage 6 being moved in the direction B.

A winding shaft 10 able to wind up the recording medium P as a roll R2 is provided on the downstream side in the transport direction A of the recording medium P of the recording head 4. In the embodiment, since the recording medium P is wound so that the recording surface becomes the outside, the winding shaft 10 rotates in the rotation direction C when the recording medium P is wound. Meanwhile, in a case of winding so that the recording surface becomes the inside, winding by reverse rotation to the rotation direction C is possible.

A contact portion with the recording medium P is provided extending in the direction B between the end portion of on the downstream side in the transport direction A of the recording medium P in the medium support unit 3, and the winding shaft 10, and a tension bar 9 able to apply a desired tension to the recording medium P is provided.

Next, the electrical configuration of the recording apparatus 1 of the embodiment will be described.

Figure 2:
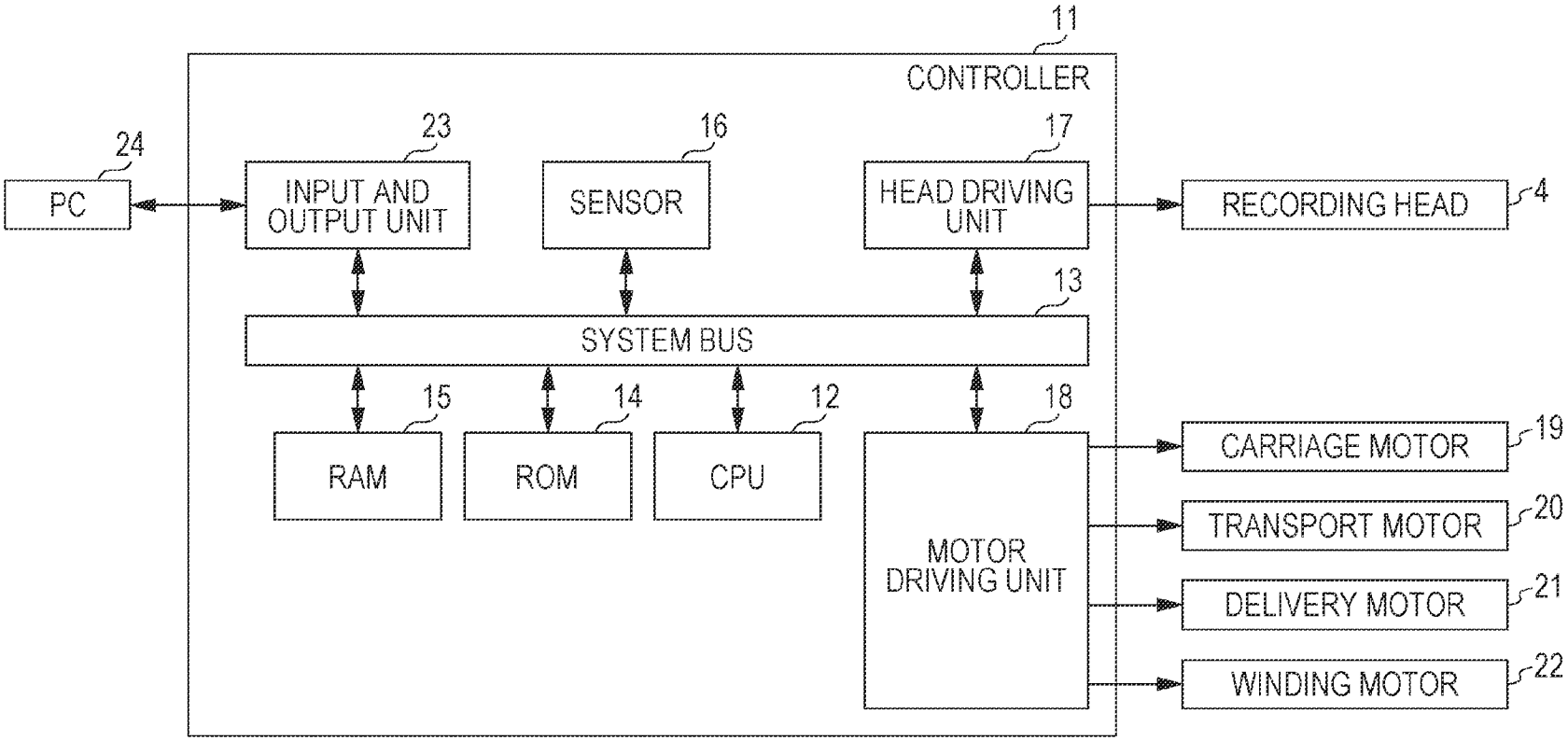
FIG. 2 is a block diagram of the recording apparatus according to an embodiment of the invention.

FIG. 2 is a block diagram of the recording apparatus 1 of the embodiment.

A CPU 12 that administers overall control of the recording apparatus 1 is provided in the controller 11. The CPU 12 is connected via a system bus 13 to the ROM 14 in which various control programs and the like executed by the CPU 12 are stored and a RAM 15 able to temporarily store data.

The CPU 12 is connected to the sensor 16 via the system bus 13.

The CPU 12 is connected via the system bus 13 to a head driving unit 17 for driving the recording head 4.

The CPU 12 is connected to the carriage motor 19, transport motor 20, delivery motor 21, and winding motor 22, and connected to the motor driving unit 18 via the system bus 13.

Here, the carriage motor 19 is a motor for driving the carriage 6 mounting to the recording head 4 in the direction B. The transport motor 20 is a motor for driving the driving roller 7 that configures the transport roller pair 5. The delivery motor 21 is a motor that is a rotation mechanism of the support shaft 2, and drives the support shaft 2 in order to deliver the recording medium P to the transport roller pair 5. The winding motor 22 is a driving motor for rotating the winding shaft 10.

The CPU 12 is further connected to the PC 24 for transmitting and receiving data, such as recording data, and signals and connected to the input-output unit 23 via the system bus 13.

The controller 11 of the embodiment is able to control the recording head 4, sensor 16, carriage 6, and the like through such a configuration.

Although described in detail later, when recording the first adjustment pattern Pb (refer to FIG. 4) that adjusts the discharge position of the ink in the direction B (first direction), the recording head 4 and carriage 6 are controlled so as to record the discharge timing adjustment pattern P2 (refer to FIGS. 5A and 5B) able to adjust the discharge timing of the ink through the discharge timing of the ink on each of the plurality of reference patterns P1 (refer to FIGS. 5A and 5B) being shifted and recorded. When recording the second adjustment pattern Pa (refer to FIG. 4) that adjusts the discharge position of the ink in the transport direction A (second direction), the recording head 4, carriage 6, and the transport unit 5 are controlled so as to transport the recording medium P by a predetermined amount after a plurality of reference patterns P1 (refer to FIG. 9) is recorded, and thereafter to record the plurality of transport amount adjustment patterns P2 (refer to FIG. 11) with the nozzle used in the nozzle row N (refer to FIG. 3) shifted with respect to each of the plurality of reference patterns P1.

The controller 11 performs control so that the adjustment pattern forming operation that adjusts the discharge position of the ink in the direction B and the transport direction A and the adjustment pattern reading operation by the sensor 16 are executed according to one instruction by a user. User instructions are able to be received via a PC 24.

In other words, the controller 11 of the embodiment performs control so that the adjustment pattern forming operation that forms the first adjustment pattern Pb that adjusts the landing position of ink in the direction B and the second adjustment pattern Pa that adjusts the landing position of ink in the transport direction A on the recording medium P and the adjustment pattern reading operation that reads the first adjustment pattern Pb and the second adjustment pattern Pa with the sensor 16 are executed according to one instruction.

In other words, the controller 11 of the embodiment performs control so that a first adjustment pattern forming operation that forms one adjustment pattern of the first adjustment pattern Pb or the second adjustment pattern Pa on the recording medium P, a first adjustment pattern reading operation that reads the one adjustment pattern formed in the first adjustment pattern forming operation with the sensor 16, a second adjustment pattern forming operation that forms the other adjustment pattern different to the adjustment pattern formed in the first adjustment pattern forming operation on the recording medium P, and a second adjustment pattern reading operation that reads the other adjustment pattern formed in the second adjustment pattern forming operation with the sensor 16 are continuously executed.

Therefore, the number of maintenance operations of the discharging unit performed before and after the formation and reading of each adjustment pattern is reduced compared to a case of individually instructing the execution of the adjustment pattern forming operation of the first adjustment pattern Pb (first adjustment pattern forming operation), the adjustment pattern forming operation of the second adjustment pattern Pa (second adjustment pattern forming operation), the adjustment pattern reading operation of the first adjustment pattern Pb (first adjustment pattern reading operation), and the adjustment pattern reading operation of the second adjustment pattern Pa (second adjustment pattern reading operation). Accordingly, the time for adjusting the position of the ink landing on the recording medium P is reduced.

The controller 11 of the embodiment performs control so that the other of the first adjustment pattern Pb or the second adjustment pattern Pa is formed on the medium P and read after forming and reading one of the first adjustment pattern Pb or the second adjustment pattern Pa on the medium P, as a control that executes (continuously) the adjustment pattern forming operation and the adjustment pattern reading operation according to one instruction. However, control may be performed so that both are read after both the first adjustment pattern Pb and the second adjustment pattern Pa are formed on the medium P.

The wording "adjust the landing position of ink" includes the meaning of all methods able to adjust the position of ink landing on the recording medium P, such as adjusting the discharge timing of ink from the nozzle row N, adjusting the nozzle that discharges the ink among the nozzle row N, and adjusting the transport amount of the recording medium P.

Here, the discharge position adjustment method able to be executed by the recording apparatus 1 of the embodiment according to control by the controller 11 is described.

Figure 15:
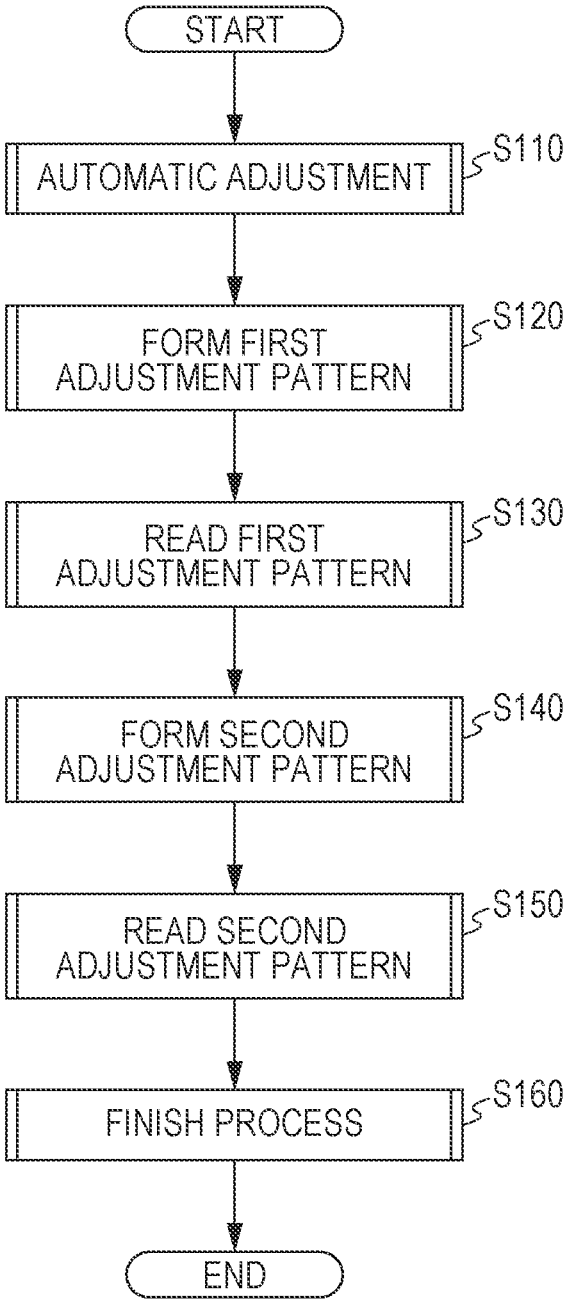
FIG. 15 is a flowchart showing a discharge position adjustment method according to an embodiment of the invention.

FIG. 15 is a flowchart showing an embodiment of the discharge position adjustment method able to be executed using the recording apparatus 1 of the embodiment.

When the discharge position adjustment method of the embodiment is started according to instruction or the like by a user, initially, automatic adjustment is performed in the recording apparatus 1 in step S110. The content of the automatic adjustment is maintenance operations and the like, such as cleaning and brushing of the recording head 4 for allowing ink to be properly discharged from the recording head 4.

Next, in the step S120, the first adjustment pattern Pb that adjusts the landing position of ink in the direction B is formed. The details of the first adjustment pattern Pb are described later.

Next, in the step S130, the first adjustment pattern Pb is read by the sensor 16.

Next, in the step S140, the second adjustment pattern Pa that adjusts the landing position of ink in the transport direction A is formed. The details of the second adjustment pattern Pa are described later.

Next, in the step S150, the second adjustment pattern Pa is read by the sensor 16.

After the finishing process of the step S160 is performed, the discharge position adjustment method of the embodiment finishes. The content of the finishing process includes maintenance operations and the like such as cleaning and brushing of the recording head 4 in addition to the discharge position adjustment process by the controller 11 based on the reading results of the first adjustment pattern Pb and the second adjustment pattern Pa.

The series of steps from the step S110 to the steps S160 is executed according to one instruction by the user.

In this way, according to the discharge position adjustment method of the embodiment, it is possible to complete the discharge position adjustment with one automatic adjustment and one finishing process with the discharge position adjustment method executed according to one instruction.

Figure 16:
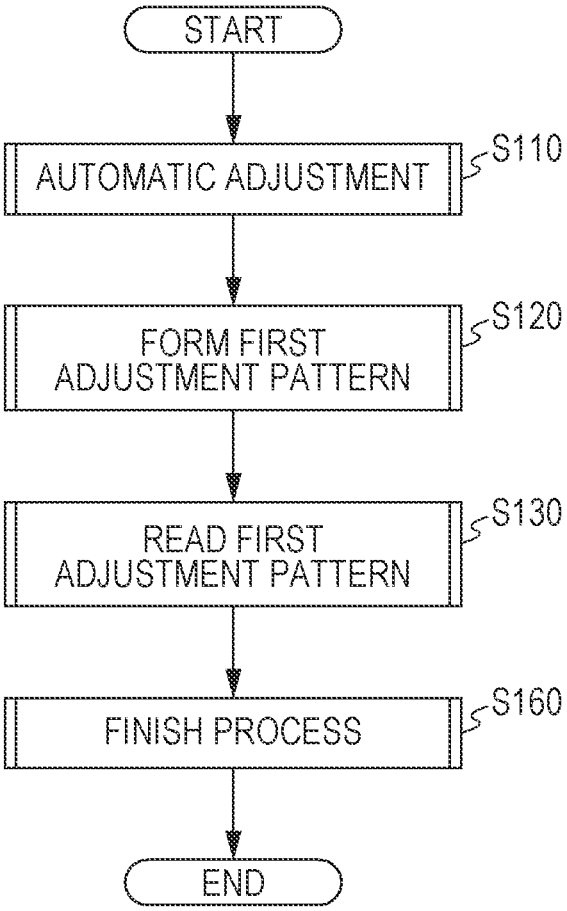
FIG. 16 is a flowchart showing a discharge position adjustment method of the related art.
Figure 17:
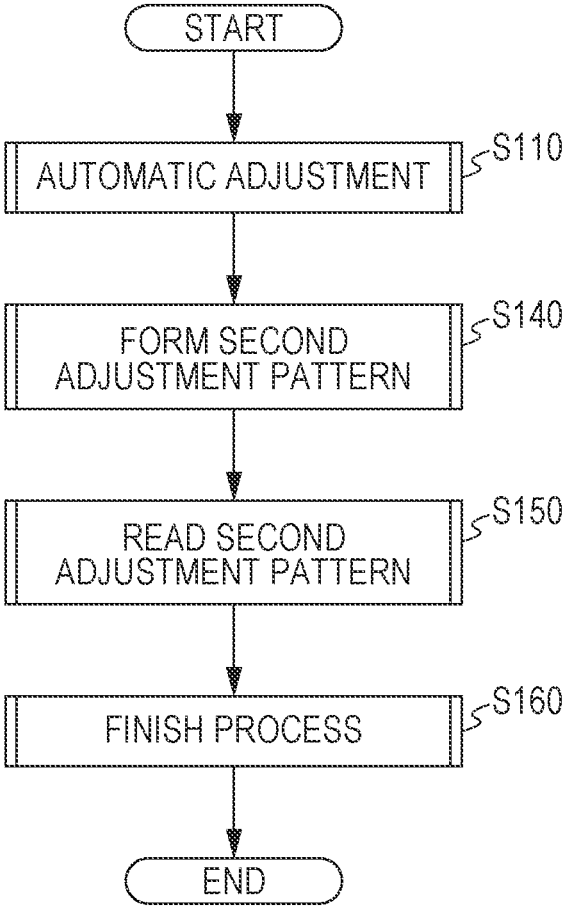
FIG. 17 is a flowchart showing the discharge position adjustment method of the related art.

Meanwhile, it is necessary for the discharge position adjustment method of the related art to individually perform the discharge position adjustment in the first direction (direction B) corresponding to the first adjustment pattern Pb shown by the flowchart in FIG. 16, and the discharge position adjustment in the second direction (transport direction A) corresponding to the second adjustment pattern Pa shown by the flowchart in FIG. 17.

Therefore, minimum of two execution instructions of the discharge position adjustment method are necessary in order for the discharge position adjustment to be completed, and, accompanying this, performing a minimum of two automatic adjustments and a minimum of two finishing processes is necessary.

Therefore, according to the discharge position adjustment method of the embodiment, the time for adjusting the position of ink landing on the recording medium P can be shortened.

Since each step in the flowcharts in FIGS. 16 and 17 is the same as the steps in the corresponding flowchart in FIG. 15, description of each step in the flowcharts in FIGS. 16 and 17 will not be provided.

Next, the recording head 4 in the recording apparatus 1 of the embodiment is described.

Figure 3:
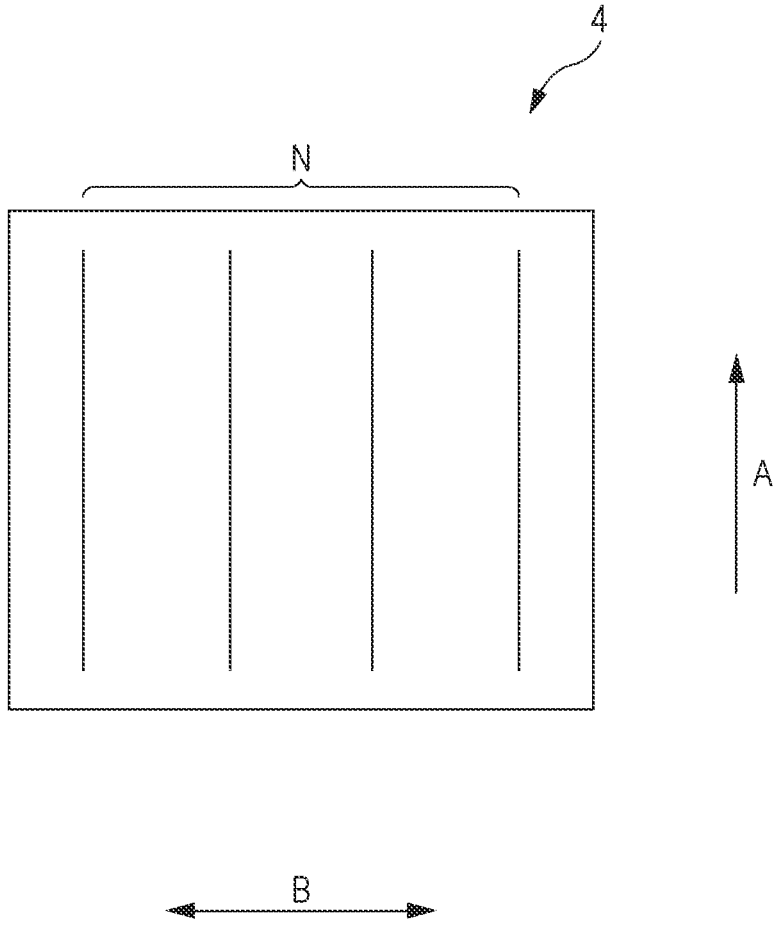
FIG. 3 is a schematic bottom view showing a recording head of the recording apparatus according to an embodiment of the invention.

FIG. 3 is a bottom view of the recording head 4 in the recording apparatus 1 of the embodiment.

As shown by FIG. 3, the recording head 4 of the embodiment includes a plurality of nozzle rows N that discharge ink. The nozzle rows N are arranged so as to be even in the direction that intersects the direction B in which the recording head 4 reciprocates. However, there is no limitation to the recording head 4 with such a configuration, and a configuration may be used in which the nozzle rows N are arranged so as to be shifted in the direction that intersects the direction B.

The recording apparatus 1 of the embodiment has a configuration able to record using black, cyan, magenta, and yellow inks. Nozzle rows N are provided corresponding to the respective inks in the recording head 4.

Here, as shown in FIG. 3, the direction of each of the nozzle rows (direction in which the nozzles are lined up in each nozzle row N) is a direction following the transport direction A that is a direction that intersects the direction B in which the recording head 4 reciprocates. In other words, the recording head 4 reciprocates in the direction B that intersects the nozzle rows N, and when the direction B that intersects the nozzle rows N is the first direction, the transport unit 5 transports the recording medium P in the transport direction A that is the second direction that intersects the first direction.

The recording apparatus 1 of the embodiment performs recording by repeating transport of the recording medium P in the transport direction A through the transport unit 5 and reciprocation of the recording head 4 in the direction B. In detail, the recording medium P is stopped after being transported a predetermined amount, and ink is discharged to the recording medium P in a stopped state while the recording head 4 is moved in the direction B. Transport of the recording medium P by a predetermined amount and discharge of the ink to the recording medium P in the stopped state is repeated.

Because the recording apparatus 1 of the embodiment performs recording by performing such intermittent transport, there is demand for adjusting the transport amount of one transport of the recording medium P according to the intermittent transport with high precision. Therefore, the recording apparatus 1 of the embodiment is configured to be able to record the second adjustment pattern Pa in order to adjust the transport amount of one transport of the recording medium P according to the intermittent transport.

The recording apparatus 1 of the embodiment as described above performs recording while the recording head 4 is reciprocated. Therefore, the recording apparatus configured to be able to record the first adjustment pattern Pb that adjusts the landing position of ink in the forward direction B2 (refer to FIGS. 5A and 5B) and the return direction B1 (refer to FIGS. 5A and 5B) from the reciprocation of the recording head 4.

Next, the adjustment pattern in the recording apparatus 1 of the embodiment is described.

Figure 4:
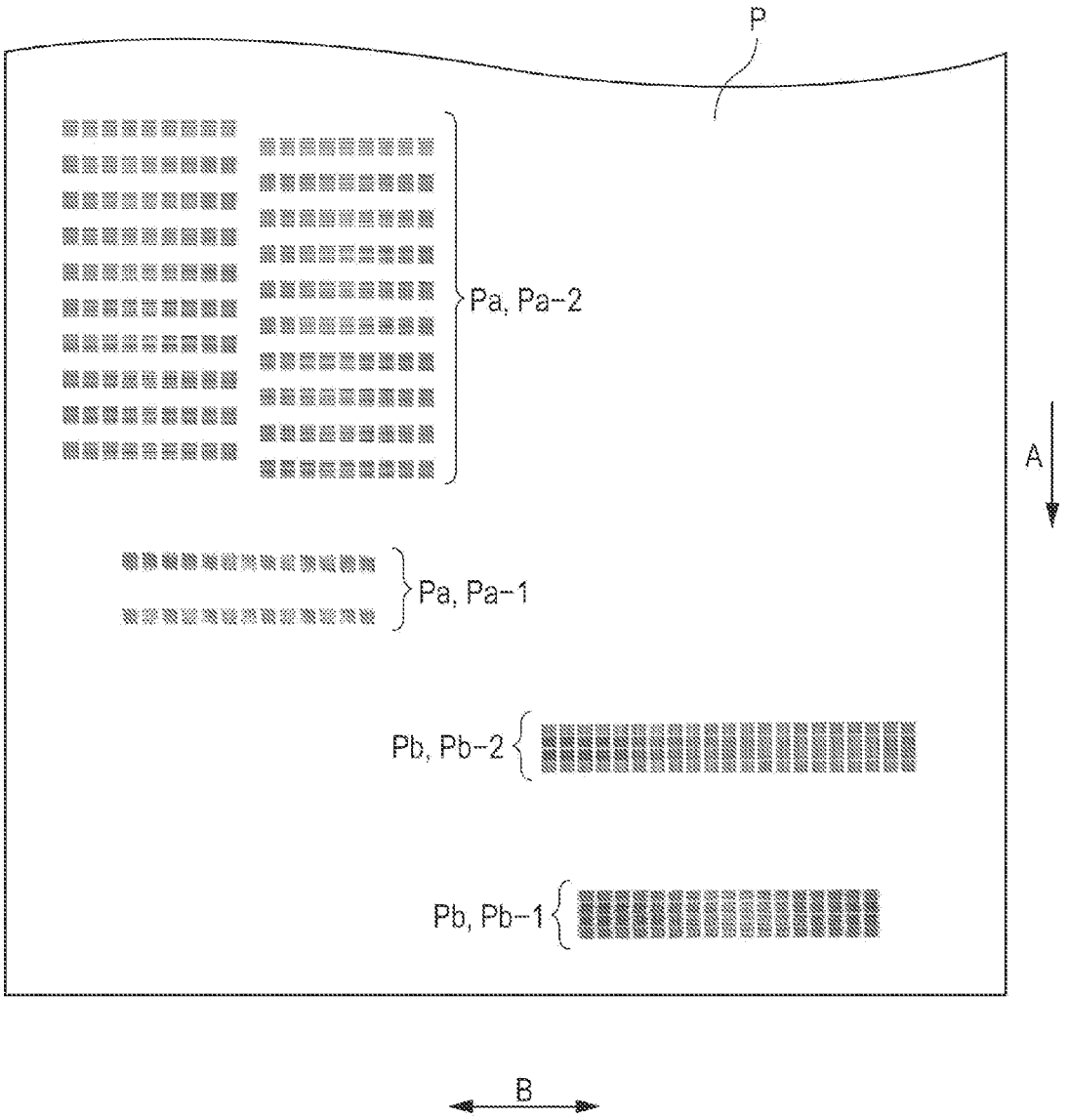
FIG. 4 is a schematic view for describing an adjustment pattern of the recording apparatus according to an embodiment of the invention.

FIG. 4 shows a state in which the first adjustment pattern Pb and the second adjustment pattern Pa are formed on the recording medium P.

The recording apparatus 1 of the embodiment forms, as the first adjustment pattern Pb, the coarse adjustment pattern Pb-1 for performing broad landing position adjustment in the direction B and a fine adjustment pattern Pb-2 for performing highly precise landing position adjustment in the direction B. The coarse adjustment pattern Pa-1 for performing broad landing position adjustment in the transport direction A and the fine adjustment pattern Pa-2 for performing highly precise landing position adjustment in the transport direction A are formed as the second adjustment pattern Pa.

Initially, the first adjustment pattern Pb in the adjustment pattern of the embodiment is described.

Figures 6A, 6B, 6C:
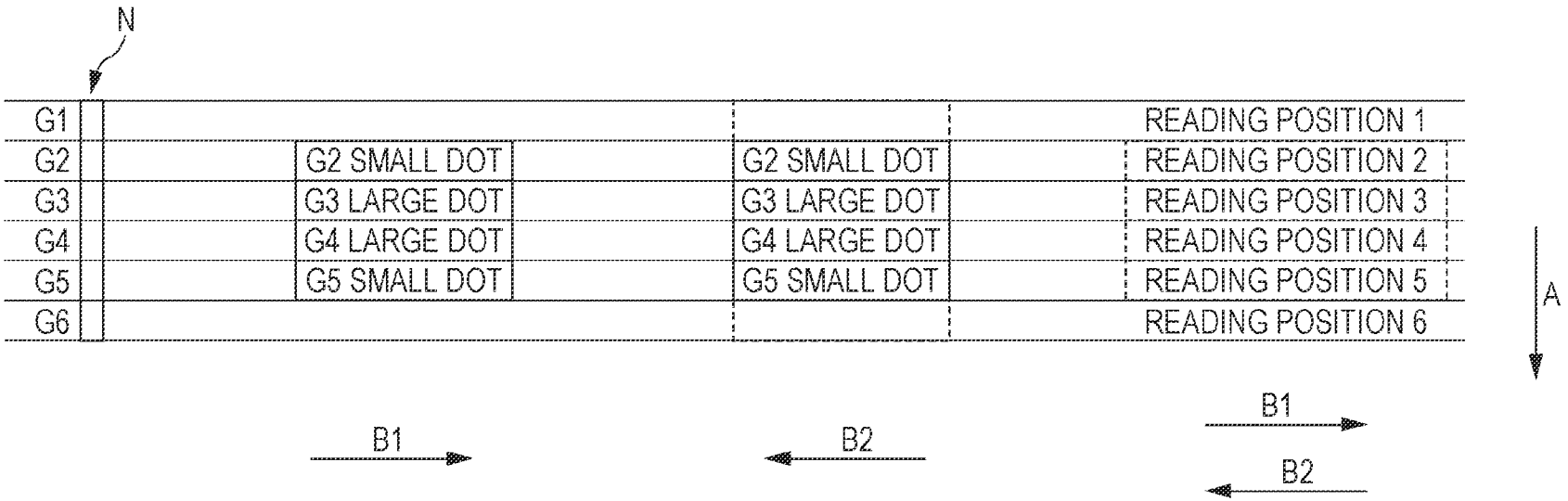
FIGS. 6A to 6C are schematic views for describing the first adjustment pattern of the recording apparatus according to an embodiment of the invention.
Figure 7C:
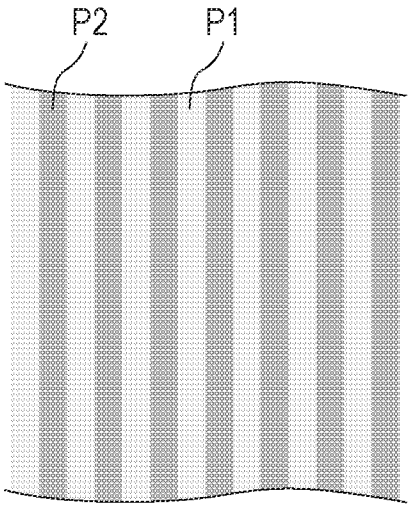
FIGS. 7A to 7C are schematic views for describing the first adjustment pattern of the recording apparatus according to an embodiment of the invention.
Figure 7B:
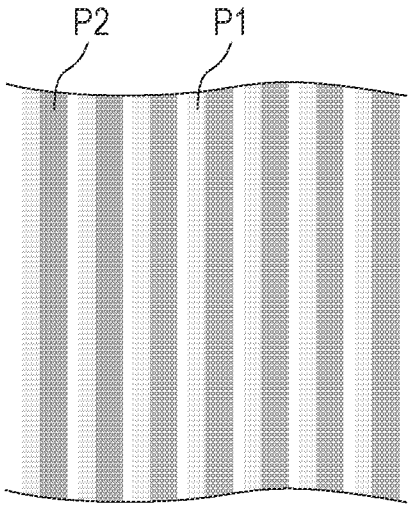
Figure 7A:
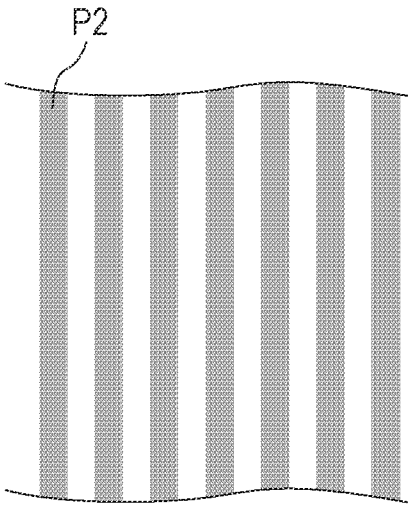
Figure 8A:
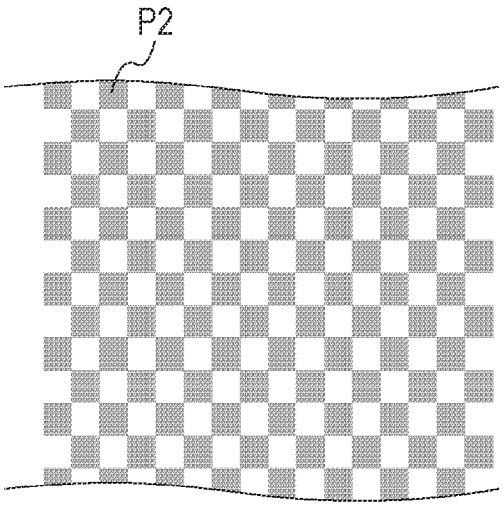
FIGS. 8A to 8C are schematic views for describing the first adjustment pattern of the recording apparatus according to an embodiment of the invention.
Figure 8B:
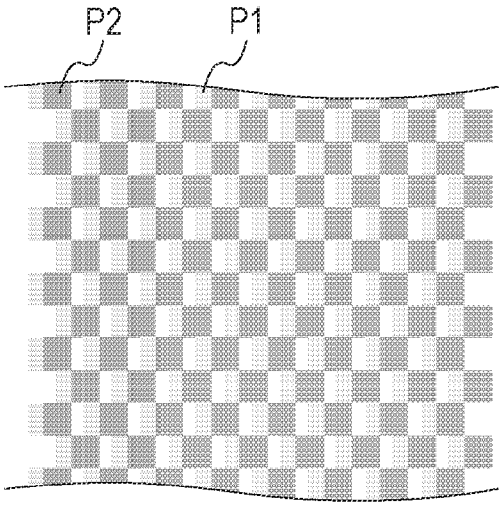
Figure 8C:
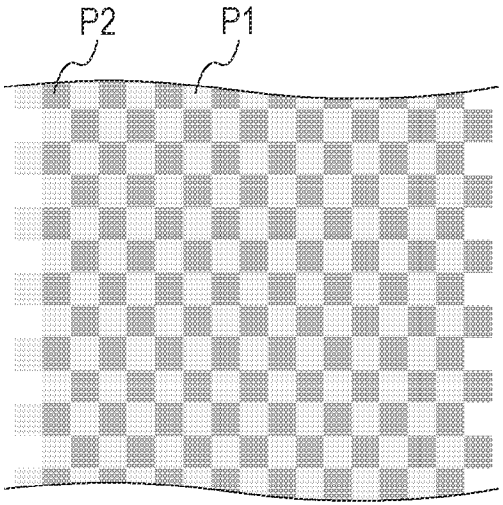

FIGS. 5A to 8C are schematic views for describing the first adjustment pattern Pb of the embodiment. Among these, FIGS. 5A to 7C are schematic views for describing the fine adjustment pattern Pb-2, and FIGS. 8A to 8C are schematic views for describing the coarse adjustment pattern Pb-1.

Here, the first adjustment pattern Pb is a reciprocation adjustment pattern for recording the reciprocation adjustment pattern P2 while shifting the discharge timing while the recording head 4 is moved in the return direction B2 with respect to the reference pattern P1 recording while the recording head 4 is moved in the forward direction B1. That is, a description of the formation of the reciprocation adjustment pattern is as follows.

Figure 5B:
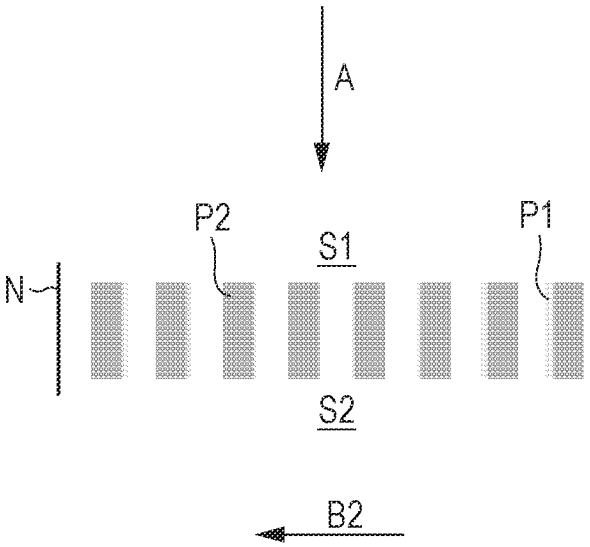
FIGS. 5A and 5B are schematic views for describing a first adjustment pattern of the recording apparatus according to an embodiment of the invention.
Figure 5A:
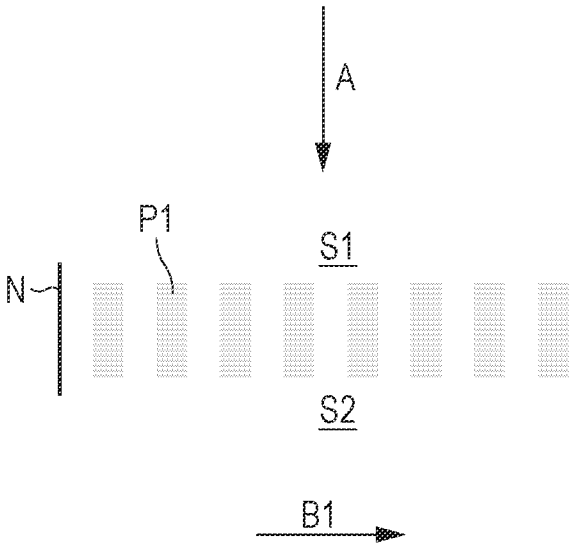

FIGS. 5A to 5C show pattern formation views for each recording process of the adjustment pattern (reference pattern P1 and reciprocation adjustment pattern P2) in the recording apparatus 1 of the embodiment. In FIGS. 5A to 5C, the pattern formation views are shown corresponding to the position of the nozzle row N in the recording head 4.

FIG. 5A shows a pattern formation view formed while the recording head 4 is moved in the forward direction B1 in the reference pattern formation process. The reference pattern P1 is schematically shown with light grey.

In this way, the recording apparatus 1 of the embodiment initially forms a plurality of reference patterns P1 while the recording head 4 is moved in the forward direction B1.

The nozzle used in forming the reference pattern P1 is a nozzle (nozzle groups G2 to G5) in which the one-sixth of the nozzles on the upstream side (nozzle group G1) and on the downstream side (nozzle group G6) in the transport direction A among the nozzle row N of the recording head 4 is removed (refer to FIGS. 6A to 6C).

Next, the recording apparatus 1 of the embodiment forms the reciprocation adjustment pattern P2 while the recording head 4 is moved in the return direction B2 in the reciprocation adjustment pattern formation process.

FIG. 5B shows a pattern formation view of the reciprocation adjustment pattern P2 shown with dark grey formed with the discharge timing of the ink being shifted for each of the plurality of reference patterns P1.

As shown in FIG. 5B, the dark grey reciprocation adjustment pattern P2 is formed with the position in the direction B shifted with respect to each of the plurality of light grey reference patterns P1. In detail, the further to the right side the reciprocation adjustment pattern P2 is, the greater the shift to the right side with respect to the reference pattern P1.

The nozzle used when forming the reciprocation adjustment pattern P2 is the nozzle used when forming the reference pattern P1.

The reference pattern P1 and the reciprocation adjustment pattern P2 are a plurality of linear patterns formed in a direction that intersects the direction B in which the recording head 4 reciprocates. It is possible to adjust the discharge timing of the ink with such a simple pattern.

FIGS. 7A to 7C show the reference pattern P1 and the reciprocation adjustment pattern P2 at three different positions in the direction B in the state shown in FIG. 5B. In FIGS. 7A to 7C and FIGS. 8A to 8C, described later, the horizontal direction corresponds to the direction B, and the vertical direction corresponds to the transport direction A.

FIG. 7A shows a state in which the reference pattern P1 and the reciprocation adjustment pattern P2 overlap. FIG. 7B shows a state in which the reference pattern P1 and the reciprocation adjustment pattern P2 are shifted. FIG. 7C shows a state in which the reference pattern P1 and the reciprocation adjustment pattern P2 are shifted further than the state in FIG. 7B.

As above, the recording apparatus 1 of the embodiment is provided with a sensor 16 on a carriage 6, and is configured to be able to read the adjustment pattern. Here, the sensor 16 is able to detect the optical density of the adjustment pattern, and the controller 11 is configured to be able to determine the adjustment position based on the optical density. Specifically, the controller 11 selects the discharge timing of ink when the pattern with the lowest optical density is recorded as the discharge timing of the ink in the reciprocation adjustment.

That is, in FIGS. 7A to 7C, the discharge timing of the ink is selected when FIG. 7A thereamong is recorded. However, there is no limitation on such a setting method of the discharge timing of the ink.

In the embodiment, although an example is provided of performing recording the reference pattern P1 and the reciprocation adjustment pattern P2 with one recording scan in the direction B of the recording head 4, it is also possible for the controller 11 to control the recording of the reference pattern P1 and the reciprocation adjustment pattern P2 with a plurality of recording scans. In a case of performing recording of the reference pattern P1 and the reciprocation adjustment pattern P2 with a plurality of recording scans, the results of shortening the adjustment time due to being able to shorten the recording time of the reference pattern P1 becomes more remarkable.

As shown in FIGS. 4 and 7A to 7C, the fine adjustment pattern Pb-2 of the embodiment is a plurality of linear patterns formed from the reference pattern P1 and the reciprocation adjustment pattern P2 formed along a direction that intersects the direction B. By making such a linear pattern, highly precise adjustment becomes easy.

Meanwhile, the coarse adjustment pattern Pb-1 of the embodiment is a plurality of grid-like patterns formed in the direction B and a direction that intersects the direction B different to one another, as shown in FIGS. 8A to 8C. By making such a grid-like pattern, broad adjustment becomes easy.

Here, FIG. 8A shows a state in which the reference pattern P1 and the reciprocation adjustment pattern P2 overlap. FIG. 8B shows a state in which the reference pattern P1 and the reciprocation adjustment pattern P2 are shifted. FIG. 8C shows a state in which the reference pattern P1 and the reciprocation adjustment pattern P2 are shifted further than the state in FIG. 8B.

The recording head 4 of the embodiment is able to discharge ink droplets with different discharge amounts (large dots and small dots) from each nozzle row N. The recording apparatus 1 of the embodiment is configured to be able to collectively perform adjustment when ink droplets with differing discharge amounts are discharged without rather than adjustment being performed individually for each discharge amount. Therefore, the adjustment time is effectively reduced.

Specifically, the discharge position of the large dots and the small dots in the nozzle row N of the recording head 4 is described using FIGS. 6A to 6C. FIG. 6A corresponds to the state in FIG. 5A, and FIG. 6B corresponds to the state in FIG. 5B. FIG. 6C shows a reading position of pattern formation part and the margin parts S1 and S2 (refer to FIG. 5) with the sensor 16.

The recording head 4 of the embodiment performs recording dividing the nozzle row N by 6 (dividing into six different regions) when recording the reference pattern P1 and the reciprocation adjustment pattern P2. Specifically, recording is performed dividing the nozzle row N into the six nozzle groups of G1, G2, G3, G4, G5, and G6.

As shown in FIG. 6A, the nozzle groups G2 and G5 record the small dots and the nozzle groups G3 and G4 record the large dots when recording the reference pattern P1.

As shown in FIG. 6B, the nozzle groups G2 and G5 record the small dots and the nozzle groups G3 and G4 record the large dots when recording the reciprocation adjustment pattern P2, similarly to when recording the reference pattern P1.

In this way, in the embodiment, forming and reading of the first adjustment pattern Pb is performed at two locations (plurality of locations) with both small dots and large dots. Therefore, it is possible to adjust the ink landing on the recording medium P in the direction B with high precision, compared to a configuration that performs adjustment at only one location.

In particular, in the embodiment, the pattern is formed so that the liquid droplets have a smaller discharge amount at the outside region than the inside region among the different regions divided into six. Therefore, adjustment of the landing position of the ink is possible under easily fluctuating conditions, and adjusting the landing position of the ink in the direction B is possible with high precision.

As shown in FIG. 6C, the reading position with the sensor 16 also includes a reading position 1 and six margin parts in addition to pattern formation parts corresponding to reading positions 2 to 5. In this way, transport failures of the recording medium P can be detected by using a configuration that also reads the margin portions.

In this way, the controller 11, as an adjustment unit, is able to automatically adjust the discharge timing of the liquid based on the reading results read by the sensor 16. Therefore, the recording apparatus 1 of the embodiment is able to automatically adjust the position of ink landing on the recording medium P in the direction B, since adjustment by the user can be omitted.

Next the second adjustment pattern Pa in the adjustment pattern of the embodiment is described.

Figure 12:
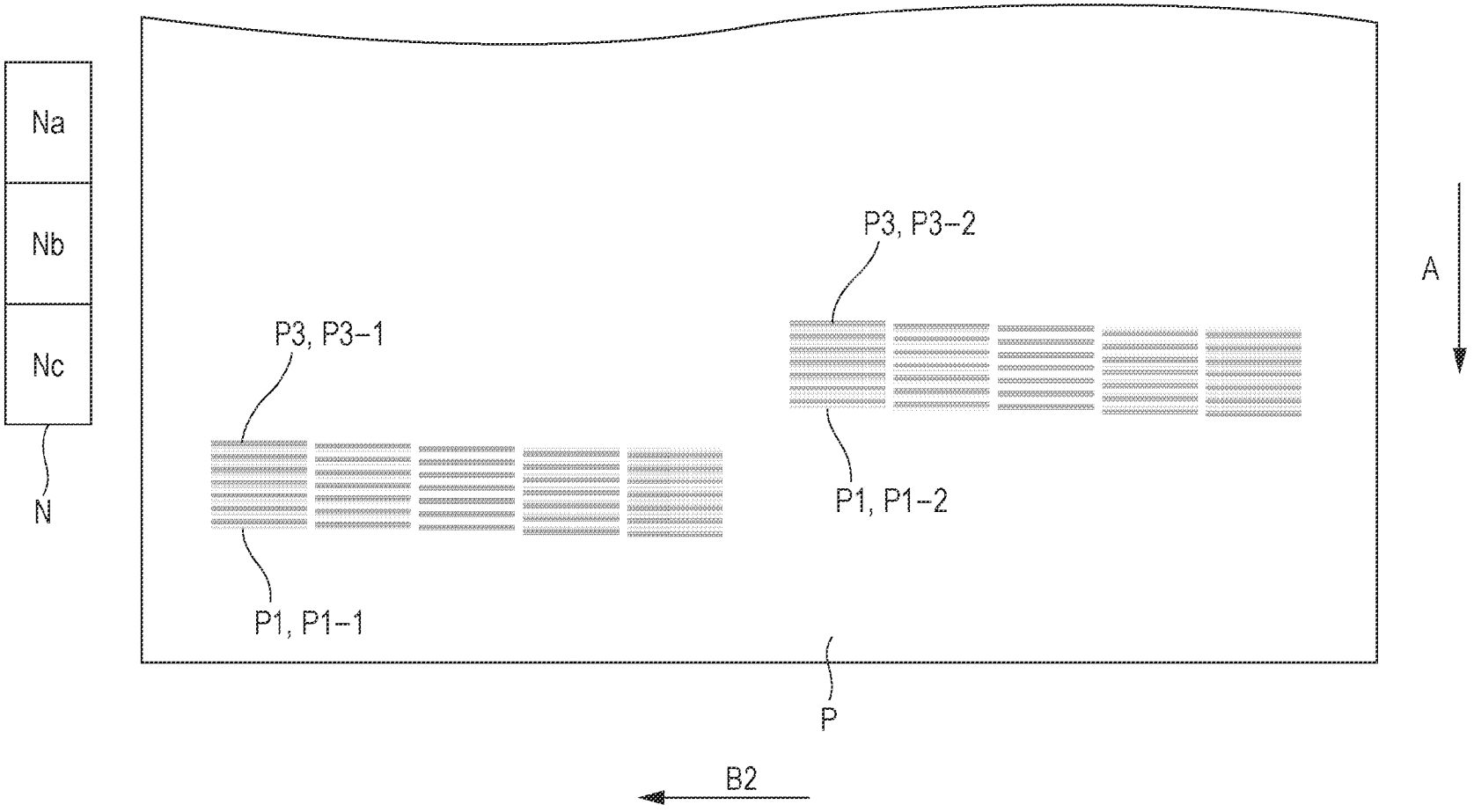
FIG. 12 is a schematic view for describing the second adjustment pattern of the recording apparatus according to an embodiment of the invention.
Figure 13C:
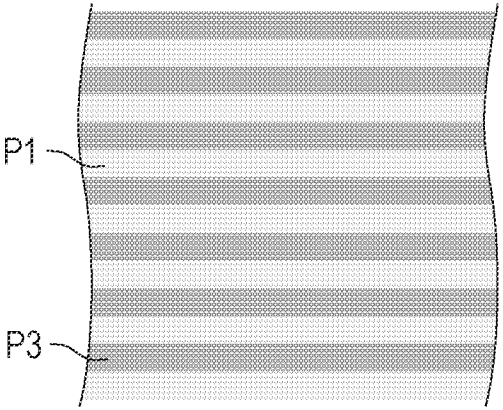
FIGS. 13A to 13C are schematic views for describing the second adjustment pattern of the recording apparatus according to an embodiment of the invention.
Figure 13B:
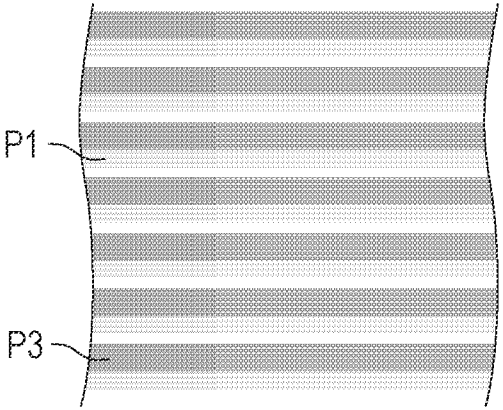
Figure 13A:
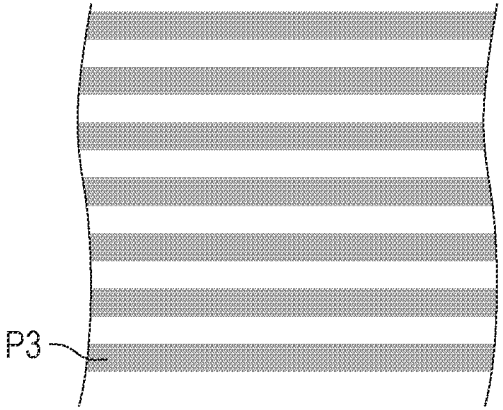
Figure 14C:
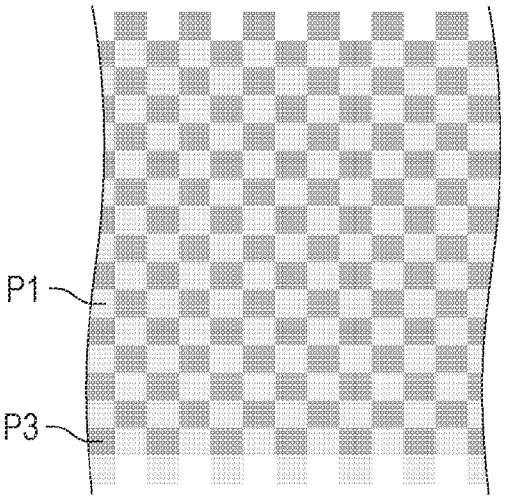
FIGS. 14A to 14C are schematic views for describing the second adjustment pattern of the recording apparatus according to an embodiment of the invention.

FIGS. 9 to 14C are schematic views for describing the second adjustment pattern Pa of the embodiment. Among these, FIGS. 9 to 13C are schematic views for describing the fine adjustment pattern Pa-2, and FIGS. 14A to 14C are schematic views for describing the coarse adjustment pattern Pa-1.

Here, the recording apparatus 1 of the embodiment is able to perform a so-called three-pass recording for forming an image at the same location on the recording medium P by causing the recording head 4 to reciprocate one and a half times in the direction B, that is, according to a total of three movements. When three-pass recording is performed, although recording is performed by dividing the nozzle rows N by three, the example of forming the second adjustment pattern Pa of the embodiment is an example of adjustment pattern of the transport amount corresponding to when the three pass recording is performed. The second adjustment pattern Pa of the embodiment is a transport amount adjustment pattern in which the recording medium P is transported by a predetermined amount after a plurality of reference patterns P1 is recorded, and, thereafter, the plurality of transport amount adjustment patterns P3 is recorded with the nozzle used in the nozzle row N being shifted with respect to each of the plurality of reference patterns.

Figure 9:
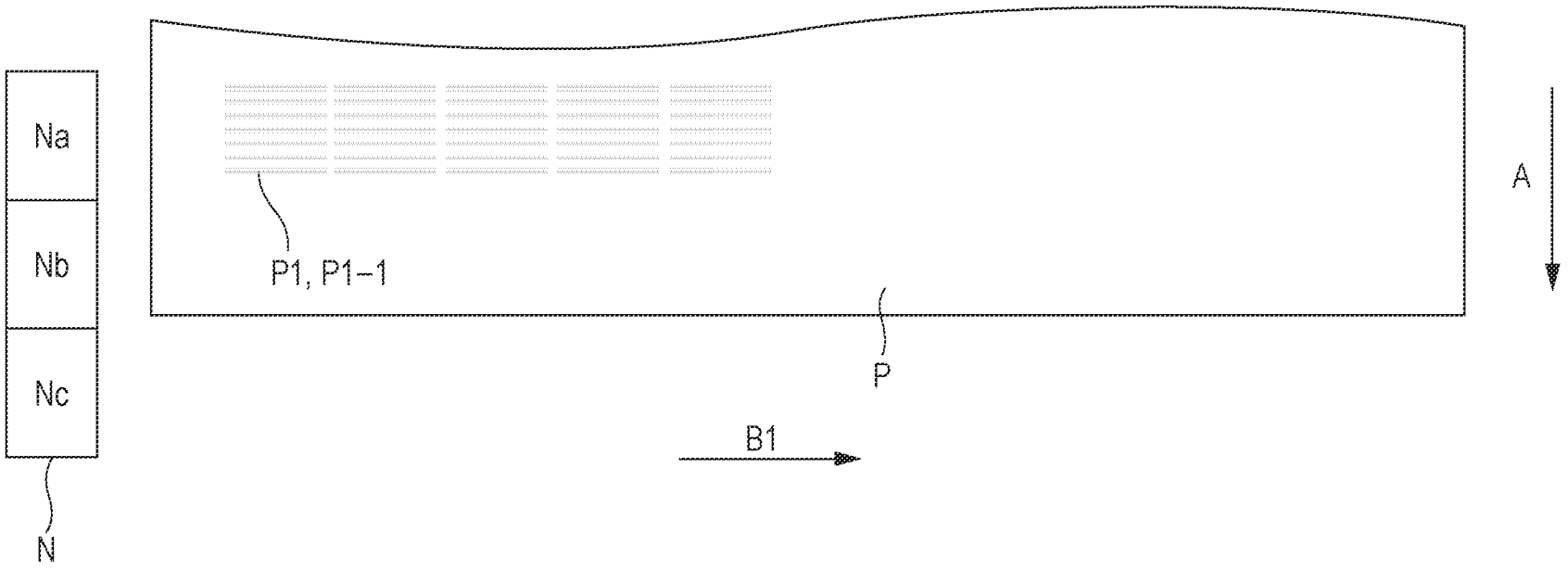
FIG. 9 is a schematic view for describing a second adjustment pattern of the recording apparatus according to an embodiment of the invention.

In the example of formation of the fine adjustment pattern Pa-2 of the embodiment, initially, the reference pattern P1-1 from the reference pattern P1 indicated in light grey is recorded by the nozzles of the region Na of the nozzle row N of the recording head 4 while the recording head 4 is moved in the forward direction B1 from the direction B, as shown in FIG. 9.

In the example of formation of the adjustment pattern of the embodiment, the nozzle row N is divided in three regions of region Na, region Nb, and region Nc, and the transport amount adjustment pattern P3 is formed using the region Nc at a position overlapping the reference pattern P1 formed using the region Na when seen from the transport direction A. That is, the region Na corresponds to the nozzle groups G1 and G2 in FIGS. 6A to 6C, the region Nb corresponds to the nozzle group G3 and G4 in FIGS. 6A to 6C, and the region Nc corresponds to the nozzle group G5 and G6 in FIGS. 6A to 6C.

In FIG. 9, although five reference patterns P1-1 with seven stages in the direction following the transport direction A are formed along the forward direction B1, all five of the reference patterns P1-1 are formed using the same nozzles in the region Na. However, the number of stages in the direction along the transport direction A or the number items in the direction along the forward direction B1 of the reference pattern P1-1 can be changed, as appropriate, according to the number of nozzles of the nozzle row N, or the like.

Figure 10:
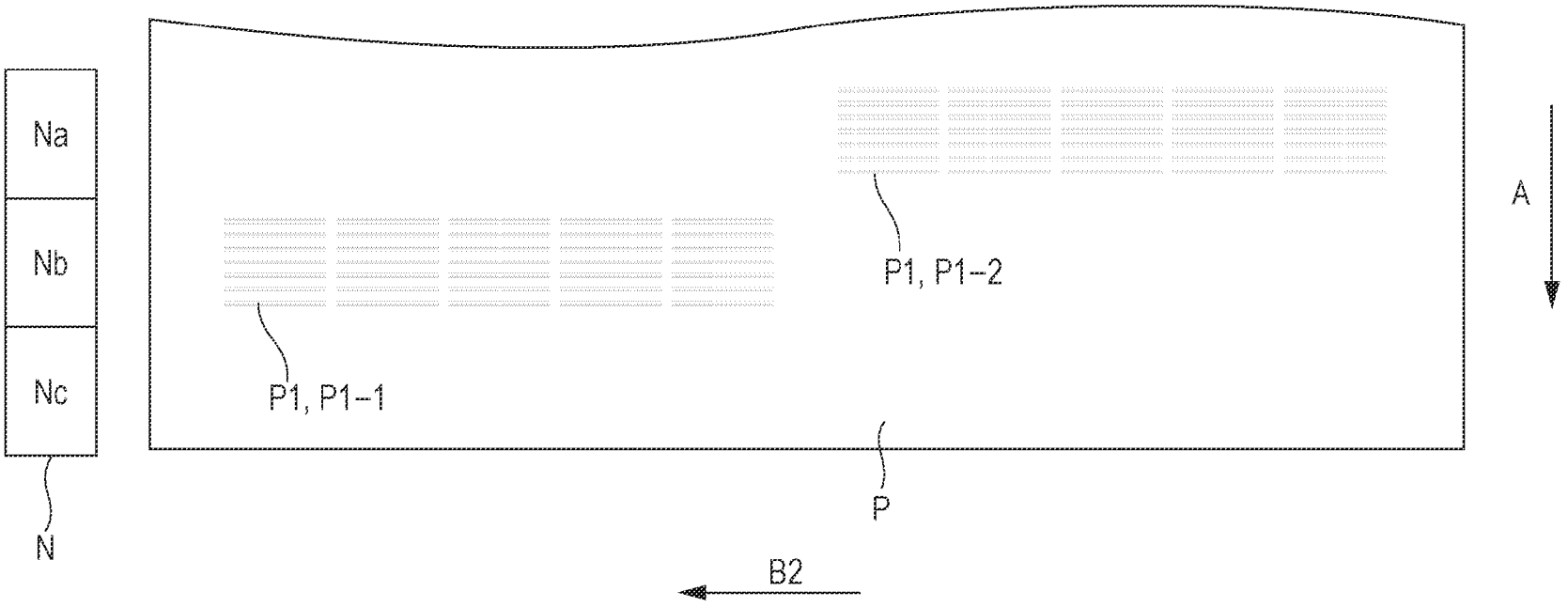
FIG. 10 is a schematic view for describing the second adjustment pattern of the recording apparatus according to an embodiment of the invention.

When the recording medium P is transported by a predetermined transport amount in the transport direction A, next, the reference pattern P1-2 from the reference pattern P1 indicated in light grey is recorded by the nozzles in the region Na of the nozzle row N of the recording head 4 while the recording head 4 is moved in the return direction B2 of the direction B, as shown in FIG. 10.

In FIG. 10, although five reference patterns P1-2 with seven stages in the direction following the transport direction A are formed along the return direction B2, all five of the reference patterns P1-2 are formed using the same nozzles in the region Na. However, the number of stages in the direction along the transport direction A or the number items in the direction along the return direction B2 of the reference pattern P1-2 can be changed, as appropriate, according to the number of nozzles of the nozzle row N, or the like.

Figure 11:
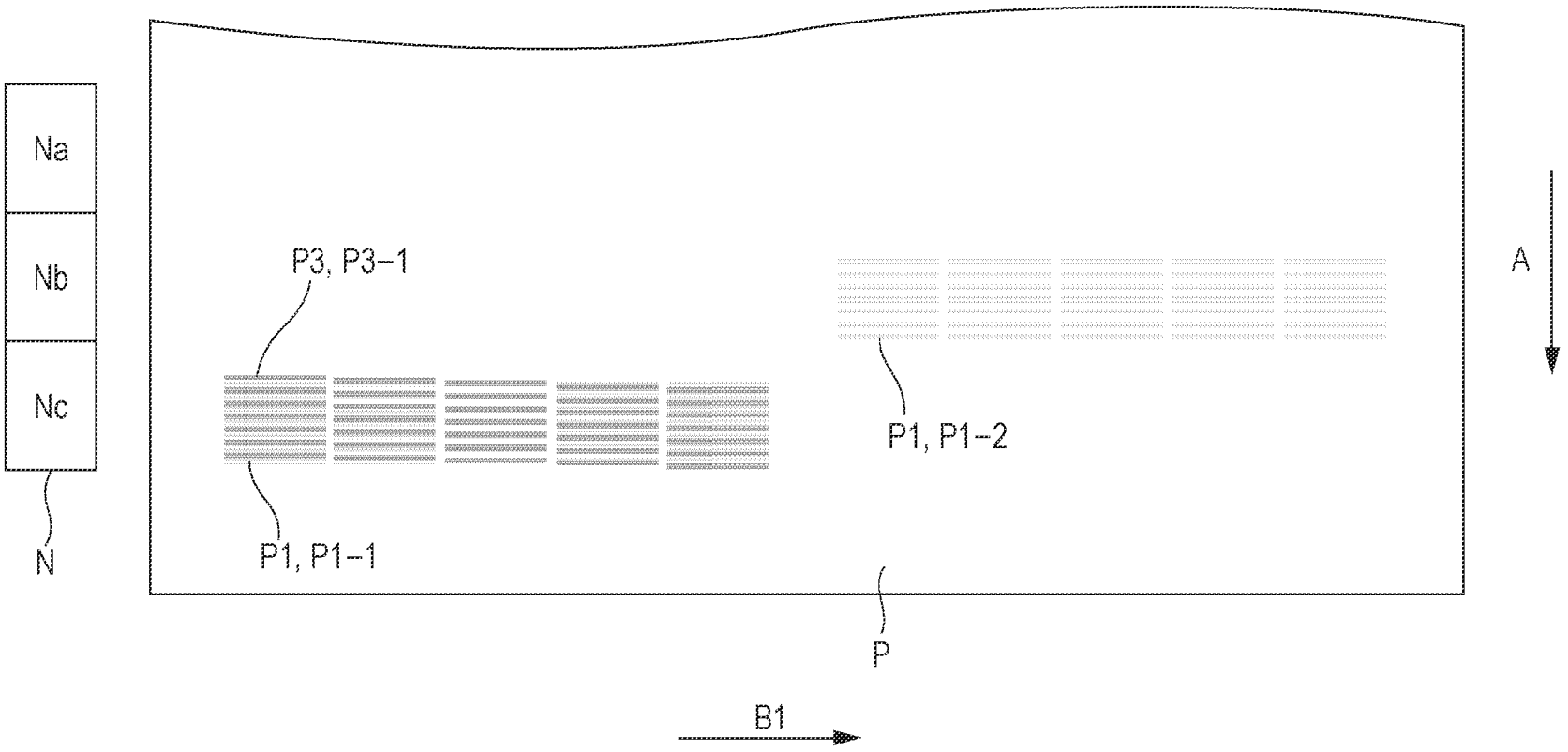
FIG. 11 is a schematic view for describing the second adjustment pattern of the recording apparatus according to an embodiment of the invention.

When the recording medium P is transported by a predetermined transport amount in the transport direction A, next, the transport amount adjustment pattern P3-1 from the transport amount adjustment pattern P3 indicated in dark grey is recorded by the nozzles in the region Nc of the nozzle row N of the recording head 4 while the recording head 4 is moved in the forward direction B1, as shown in FIG. 11.

In FIG. 11, although five transport amount adjustment patterns P3-1 with seven stages in the direction following the transport direction A are formed along the forward direction B1, the five transport amount adjustment patterns P3-1 are each formed using different nozzles in the region Nc. In detail, the five transport amount adjustment patterns P3-1 are formed with the nozzles used shifted to the downstream side in the transport direction A in the region Nc toward the right side in the drawing. In FIG. 11, the transport amount adjustment pattern P3-1 in the center of the drawing from the five transport amount adjustment patterns P3-1 overlaps the reference pattern P1-1. In this way, the transport amount corresponding to a case where the reference pattern P1-1 and the transport amount adjustment pattern P3-1 overlap becomes the desired transport amount.

However, the number of stages in the direction along the transport direction A or the number items in the direction along the forward direction B1 of the transport amount adjustment pattern P3-1 can be changed, as appropriate, according to the number of nozzles of the nozzle row N, or the like.

When the recording medium P is transported by a predetermined transport amount in the transport direction A, next, the transport amount adjustment pattern P3-2 from the transport amount adjustment pattern P3 indicated in dark grey is recorded by the nozzles in the region Nc of the nozzle row N of the recording head 4 while the recording head 4 is moved in the return direction B2, as shown in FIG. 12.

In FIG. 12, although five transport amount adjustment patterns P3-2 with seven stages in the direction following the transport direction A are formed along the return direction B2, the five transport amount adjustment patterns P3-2 are each formed using different nozzles in the region Nc. In detail, the five transport amount adjustment patterns P3-2 are formed with the nozzles used shifted to the downstream side in the transport direction A in the region Nc toward the right side in the drawing. In FIG. 12, the transport amount adjustment pattern P3-2 in the center of the drawing from the five transport amount adjustment patterns P3-2 overlaps the reference pattern P1-2. In this way, the transport amount corresponding to a case where the reference pattern P1-2 and the transport amount adjustment pattern P3-2 overlap becomes the desired transport amount.

However, the number of stages in the direction along the transport direction A or the number items in the direction along the return direction B2 of the transport amount adjustment pattern P3-2 can be changed, as appropriate, according to the number of nozzles of the nozzle row N, or the like.

The sensor 16 is able to read the fine adjustment pattern Pa-2 formed in this way according to the control of the controller 11. The controller 11 is able to perform adjustment to the appropriate transport amount based on the reading results of the sensor 16.

Here, the reference pattern P1 and the transport amount adjustment pattern P3 are a plurality of linear patterns formed along the direction B in which the recording head 4 reciprocates. It is possible to adjust the transport amount of the recording medium P with a simple pattern.

FIGS. 13A to 13C show the second adjustment pattern Pa at three different positions from among the five second adjustment patterns Pa (reference pattern P1 and transport amount adjustment pattern P3) formed lined up in the direction B in the state shown in FIGS. 11 and 12. In FIG. 13A to 14C, described later, the horizontal direction corresponds to the direction B, and the vertical direction corresponds to the transport direction A.

FIG. 13A shows a state in which the reference pattern P1 and the transport amount adjustment pattern P3 overlap. FIG. 13B shows a state in which the reference pattern P1 and the transport amount adjustment pattern P3 are shifted. FIG. 13C shows a state in which the reference pattern P1 and the transport amount adjustment pattern P3 are shifted further than the state in FIG. 13B.

As above, the recording apparatus 1 of the embodiment is provided with a sensor 16 on a carriage 6, and is configured to be able to read the adjustment pattern. The sensor 16 is able to detect the optical density of the adjustment pattern based on the reflection intensity of light from the recording medium P, and the controller 11 is configured to be able to determine the transport amount of the recording medium P based on the optical density. Specifically, the controller 11 selects the pattern with the lowest optical density detected by the sensor 16, and is able to adjust the appropriate transport amount based on the information pertaining to the position thereof.

However, there is no limitation on such a setting method of the transport amount of the recording medium P.

As shown in FIGS. 9 to 13C, the fine adjustment pattern Pa-2 of the embodiment is a plurality of linear patterns formed from the reference pattern P1 and the transport amount adjustment pattern P3 formed along the direction B. By making such a linear pattern, highly precise adjustment becomes easy.

Figure 14B:
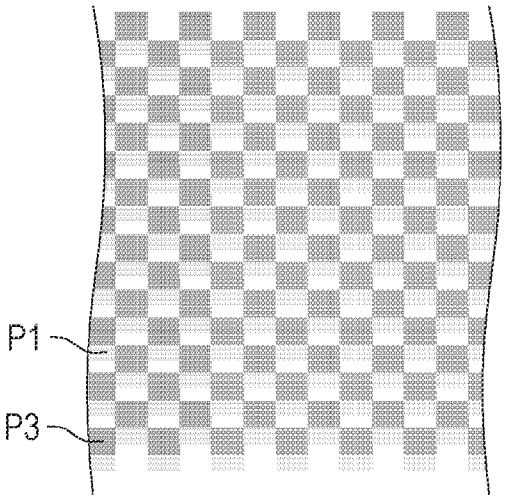
Figure 14A:
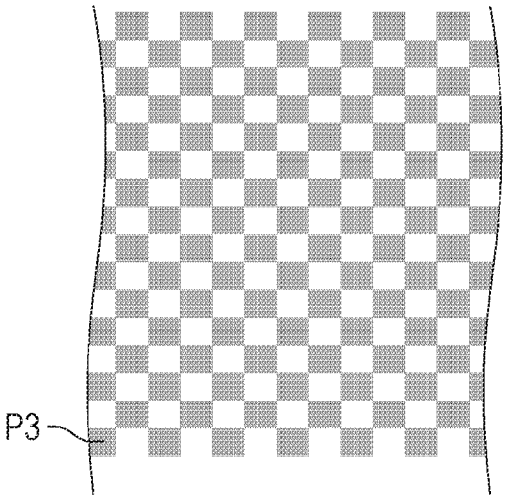

Meanwhile, the coarse adjustment pattern Pa-1 of the embodiment is a plurality of grid-like patterns formed in the direction B and a direction that intersects the direction B different to one another, as shown in FIGS. 14A to 14C. By making such a grid-like pattern, broad adjustment becomes easy.

FIG. 13A shows a state in which the reference pattern P1 and the transport amount adjustment pattern P3 overlap. FIG. 13B shows a state in which the reference pattern P1 and the transport amount adjustment pattern P3 are shifted. FIG. 13C shows a state in which the reference pattern P1 and the transport amount adjustment pattern P3 are shifted further than the state in FIG. 13B.

The controller 11, as an adjustment unit, is able to automatically adjust the transport amount of the one transport of the recording medium P according to the intermittent transport based on the reading results read by the sensor 16. Therefore, the recording apparatus 1 of the embodiment is able to automatically adjust the position of ink landing on the recording medium P in the transport direction A, since adjustment by the user can be omitted.

The recording apparatus 1 of the embodiment has a configuration that forms the second adjustment pattern Pa and reads the second adjustment pattern Pa with the sensor 16 after the forming of the first adjustment pattern Pb and reading the first adjustment pattern Pb with the sensor 16 with one instruction from the user.

Here, in a case where the first adjustment pattern Pb is read after the first adjustment pattern Pb and the second adjustment pattern Pa are formed, at least one transport of the recording medium P necessarily accompanies when forming the second adjustment pattern Pa, and thus transport of the recording medium P necessarily accompanies when reading the first adjustment pattern Pb after forming the first adjustment pattern Pb. When the transport of the recording medium P accompanies, there are cases where shifting in the reading position by the sensor 16 occurs, and cases where the reading precision is lowered.

However, the recording apparatus 1 of the embodiment is able to eliminate or reduce the number of transports of the recording medium P until the first adjustment pattern Pb is read after forming the first adjustment pattern Pb through such a configuration. Accordingly, lowering of the reading precision by the reading unit is suppressed.

The recording apparatus 1 of the embodiment is able to transport the recording medium P a predetermined amount until the second adjustment pattern Pa is formed after forming the first adjustment pattern Pb according to the control by the controller 11.

The distance between the transport roller pair 5 that transports the recording medium P and the leading end of the recording medium P in the transport direction A of the recording medium P is lengthened by transporting the recording medium P by a predetermined amount before forming an image on the recording medium P. In so doing, there are cases where the transport precision of the recording medium P is improved.

The recording apparatus 1 of the embodiment is able to transport the recording medium P by a predetermined amount until the second adjustment pattern Pa is formed after forming the first adjustment pattern Pb, and thus the transport precision of the recording medium P can be improved. The increase in the usage amount of the recording medium P in the transport direction A can be reduced by forming the first adjustment pattern Pb at a part transported by a predetermined amount.

Meanwhile, the first adjustment pattern Pb is formed and the first adjustment pattern Pb can be read by the sensor 16 after forming the second adjustment pattern Pa and reading the second adjustment pattern Pa with the sensor 16 with one instruction from the user.

That is, a configuration is used in which the first adjustment pattern Pb as another adjustment pattern is formed after adjustment according to the reading results of the second adjustment pattern Pa as one adjustment pattern.

In this way, it is possible to reflect the adjustment in the transport direction A, to form the first adjustment pattern Pb and to read the first adjustment pattern Pb by forming the second adjustment pattern Pa and reading the second adjustment pattern Pa before executing forming of the first adjustment pattern Pb and reading of the first adjustment pattern Pb. Therefore, it is possible to suppress the reading precision of the first adjustment pattern Pb from lowering through the transport precision of the recording medium P corresponding to the transport direction A being low.

That is, a configuration may be used in which the second adjustment pattern Pa as another adjustment pattern is formed after adjustment according to the reading results of the first adjustment pattern Pb as one adjustment pattern.

The recording apparatus 1 of the embodiment forms the first adjustment pattern Pb and the second adjustment pattern Pa arranged to not overlap when viewed from the direction B in the example of the formation of the adjustment pattern shown in FIG. 4.

Meanwhile, the first adjustment pattern Pb and the second adjustment pattern Pa may be formed lined up in the direction B. By doing so, it is possible to reduce the usage amount of the recording medium P in the transport direction A used in forming the first adjustment pattern Pb and the second adjustment pattern Pa further than in a case of forming the first adjustment pattern Pb and the second adjustment pattern Pa arranged not to overlap when seen from the direction B.

The invention is not limited to the embodiments described above and can be changed in various ways within the aspects described in the aspects, and the modifications should be construed as being included in the invention.

Above, the invention was described in detail based specific embodiments of the invention. Here, The invention will be summarized again and described.

According to a first aspect of the invention, a liquid discharging apparatus 1 includes a discharging unit 4 that includes a nozzle row N that discharges a liquid, and that is able to reciprocate in a first direction B that intersects the nozzle row N; a transport unit 5 that transports a medium P in a second direction A that intersects the first direction B; and a reading unit 16 that reads a pattern formed by the liquid discharged from the discharging unit 4 to the medium P, in which the liquid discharging apparatus 1 is configured to be able to continuously execute a first adjustment pattern forming operation for forming an adjustment pattern of one of a first adjustment pattern Pb for adjusting a landing position of the liquid discharged from the discharging unit 4 in the first direction B or a second adjustment pattern Pa for adjusting the landing position of the liquid discharged from the discharging unit 4 in the second direction A is formed on the medium P, a first adjustment pattern reading operation for reading the one adjustment pattern formed in the first adjustment pattern forming operation with the reading unit 16, a second adjustment pattern forming operation for forming the other adjustment pattern different to the adjustment pattern formed in the first adjustment pattern forming operation on the medium P, and a second adjustment pattern reading operation for reading the other adjustment pattern formed in the second adjustment pattern forming operation with the reading unit 16.

The wording "adjust the landing position of the liquid" signifies including all methods able to adjust the position of a liquid landing on the recording medium P, such as adjusting the discharge timing of liquid from the nozzle row N, adjusting the nozzle that discharges the liquid among the nozzle row N, and adjusting the transport amount of the recording medium P.

According to the aspect, a first adjustment pattern forming operation that forms one adjustment pattern of the first adjustment pattern Pb for adjusting the landing position of the liquid discharged from the discharging unit 4 in the first direction B or the second adjustment pattern Pa for adjusting the landing position of the liquid discharged from the discharging unit 4 in the second direction A on the recording medium P, a first adjustment pattern reading operation that reads the one adjustment pattern formed in the first adjustment pattern forming operation with the reading unit 16, a second adjustment pattern forming operation that forms the other adjustment pattern different to the adjustment pattern formed in the first adjustment pattern forming operation on the recording medium P, and a second adjustment pattern reading operation that reads the other adjustment pattern formed in the second adjustment pattern forming operation with the reading unit 16 are continuously executed. Therefore, it is possible to reduce the number of maintenance operations of the discharging unit 4 before and after forming and reading each pattern, compared to a case where first adjustment pattern forming operation, the second adjustment pattern forming operation, the first adjustment pattern reading operation, and the second adjustment pattern reading operation are executed with individual instructions. Accordingly, it is possible for the time for adjusting the position of the liquid landing on the recording medium P to be reduced.

An example of continuously executing the adjustment pattern forming operation and the adjustment pattern reading operation includes reading both the first adjustment pattern Pb and the second adjustment pattern Pa after forming both on the medium P. In addition, an example thereof includes forming the other of the first adjustment pattern Pb and the second adjustment pattern Pa on the recording medium P and reading the other after forming one of the first adjustment pattern Pb and the second adjustment pattern Pa on the medium P and reading the one.

According to a second aspect of the invention, in the liquid discharging apparatus 1 in the first aspect, the other adjustment pattern is formed after adjustment according to reading results of the one adjustment pattern.

According to the aspect, the other adjustment pattern is formed after adjustment according to the reading results of the one adjustment pattern. In this way, it is possible to reflect the adjustment in the one adjustment pattern, to form the other adjustment pattern and read other adjustment pattern by forming the one adjustment pattern and reading the one adjustment pattern before forming the other adjustment pattern and reading the other adjustment pattern. Therefore, the reading precision of the other adjustment pattern can be improved.

According to the third aspect of the invention, in the liquid discharging apparatus 1 in the first or second aspect, in the first and second adjustment pattern forming operations, the first adjustment pattern Pb and the second adjustment pattern Pa are formed lined up in the first direction B.

According to the aspect, the first adjustment pattern Pb and the second adjustment pattern Pa are formed lined up in the first direction B in the first adjustment pattern forming operation and the second adjustment pattern forming operation. Therefore, it is possible to reduce the usage amount of the medium P in the second direction A used in forming the first adjustment pattern Pb and the second adjustment pattern Pa further than in a case of forming the first adjustment pattern Pb and the second adjustment pattern Pa arranged not to overlap when seen from the first direction B.

According to a fourth aspect of the invention, the liquid discharging apparatus 1 of any one of the first to third aspects forms the second adjustment pattern Pa and reads the second adjustment pattern Pa with the reading unit 16 after forming the first adjustment pattern Pb and reading the first adjustment pattern Pb with the reading unit 16.

In a case where the first adjustment pattern Pb and the second adjustment pattern Pa are read after the first adjustment pattern Pb and the second adjustment pattern Pa are formed, the transport of the medium P accompanies when forming at least the second adjustment pattern Pa, and thus transport of the medium P necessarily accompanies when reading the first adjustment pattern Pb after forming the first adjustment pattern Pb. When the transport of the recording medium P accompanies, there are cases where shifting in the reading position by the reading unit 16 occurs, and cases where the reading precision is lowered.

According to the aspect, the second adjustment pattern Pa is formed and the second adjustment pattern Pa is read by the reading unit 16 after forming the first adjustment pattern Pb and reading the first adjustment pattern Pb with the reading unit 16. Therefore, it is possible to eliminate transport or reduce the number of transports of the medium P until reading after forming the first adjustment pattern Pb. Accordingly, lowering of the reading precision by the reading unit 16 is suppressed.

According to a fifth aspect of the invention, the liquid discharging apparatus 1 of the fourth aspect transports the medium P by a predetermined amount until the second adjustment pattern Pa is formed after forming the first adjustment pattern Pb.

By transporting the medium P by a predetermined amount before forming an image on the medium P, the distance between the transport unit 5 of the medium P and the leading end of the medium P in the transport direction A of the medium P is lengthened. In so doing, there are cases where the transport precision of the medium P is improved. According to the aspect, the medium P is transported by a predetermined amount until the second adjustment pattern Pa is formed after forming the first adjustment pattern Pb. Therefore, the transport precision of the medium P can be improved. The first adjustment pattern Pb can be formed at a part transported by a predetermined amount, and thus the increase in the usage amount of the medium P in the second direction A can be reduced by forming the first adjustment pattern Pb at the part.

According to a sixth aspect of the invention, the liquid discharging apparatus 1 of any one of the first to third aspects forms the first adjustment pattern Pb and reads the first adjustment pattern Pb with the reading unit 16 after forming the second adjustment pattern Pa and reading the second adjustment pattern Pa with the reading unit 16.

According to the aspect, the first adjustment pattern Pb is formed and the first adjustment pattern Pb is read by the reading unit 16 after forming the second adjustment pattern Pa and reading the second adjustment pattern Pa with the reading unit 16. In this way, it is possible to reflect the adjustment in the second direction A, to form the first adjustment pattern Pb and to read the first adjustment pattern Pb by forming the second adjustment pattern Pa and reading the second adjustment pattern Pa before executing forming of the first adjustment pattern Pb and reading of the first adjustment pattern Pb. Therefore, it is possible to suppress the reading precision of the first adjustment pattern Pb from lowering through the transport precision of the medium P corresponding to the second direction A being low.

According to a seventh aspect of the invention, the liquid discharging apparatus 1 of any one of the first to sixth aspects further includes an adjustment unit 11 that adjusts the landing position of the liquid based on the reading results of the first adjustment pattern Pb and the second adjustment pattern Pa by the reading unit 16.

According to the aspect, an adjustment unit 11 that adjusts the landing position of the liquid based on the reading results of the first adjustment pattern Pb and the second adjustment pattern Pa by the reading unit 16 is provided. Therefore, since it is possible to omit the adjustment by the user, it is possible to automatically adjust the position of the liquid landing on the medium P.

According to an eighth aspect of the invention, in the liquid discharging apparatus 1 of any one of the first to seventh aspects, the first adjustment pattern Pb is formed from a plurality of reference patterns P1, and has an adjustment pattern P2 that is able to adjust the discharge timing of the liquid by the liquid being discharged with the discharge timing of the liquid shifted with respect to the plurality of reference patterns P1.

According to the aspect, the first adjustment pattern Pb forms a plurality of reference patterns P1, and includes an adjustment pattern P2 that is able to adjust the discharge timing of the liquid by the liquid being discharged with the discharge timing of the liquid being shifted with respect to the plurality of reference patterns P1. Therefore, it is possible to adjust the position of the liquid landing on the medium P in the first direction B with high precision through such a simple adjustment pattern.

According to a ninth aspect of the invention, in the liquid discharging apparatus 1 of any one of the first to eighth aspects, the reading unit 16 is able to read a plurality of locations in the first adjustment pattern P1 corresponding to different regions in the nozzle row N.

According to the aspect, the reading unit 16 is able to read a plurality of locations corresponding different regions among the nozzle row N in the first adjustment. Therefore, it is possible to adjust the position of the liquid landing on the medium P in the first direction B with high precision.

According to a tenth aspect of the invention, in the liquid discharging apparatus 1 of the ninth aspect, the nozzle row N is able to discharge liquid droplets with different discharge amounts, and the first adjustment pattern Pb is formed so that an outside region has droplets with a smaller discharge amount than the inside region among the different regions.

The position of the liquid landing on the medium P more easily fluctuates at outside region than the inside region. The position of the liquid landing on the medium P more easily fluctuates for liquid droplets with a small discharge amount.

According to the aspect, the first adjustment pattern is formed so that the liquid droplets have a smaller discharge amount at the outside region than the inside region among the different regions. Therefore, adjustment of the landing position of the liquid is possible under easily fluctuating conditions, and adjusting the landing position of the liquid in the first direction B is possible with high precision.

According to an eleventh aspect of the invention, the liquid discharging apparatus 1 of any one of the first to tenth aspects forms the first adjustment pattern Pb while the discharging unit 4 is reciprocated in the first direction B a plurality of times.

According to the aspect, the first adjustment pattern Pb is formed while the discharging unit 4 is reciprocated a plurality of times in the first direction B. Therefore, the first adjustment pattern Pb can be recorded with a plurality of passes.

According to a twelfth aspect of the invention, a liquid discharge position adjustment method is executable using a liquid discharging apparatus 1 provided with a discharging unit 4 that includes a nozzle row N that discharges a liquid and that is able to reciprocate in a first direction B that intersects the nozzle row N, a transport unit 5 that transports a medium P in a second direction A that intersects the first direction B, and a reading unit 16 that reads a pattern formed by the liquid discharged from the discharging unit 4 to the medium P, the method including continuously executing a first adjustment pattern forming operation for forming an adjustment pattern of one of a first adjustment pattern Pb for adjusting a landing position of the liquid discharged from the discharging unit 4 in the first direction B or a second adjustment pattern Pa for adjusting the landing position of the liquid discharged from the discharging unit 4 in the second direction A is formed on the medium P, a first adjustment pattern reading operation for reading the one adjustment pattern formed in the first adjustment pattern forming operation with the reading unit 16, a second adjustment pattern forming operation for forming the other adjustment pattern different to the adjustment pattern formed in the first adjustment pattern forming operation on the medium P, and a second adjustment pattern reading operation for reading the other adjustment pattern formed in the second adjustment pattern forming operation with the reading unit 16.

According to the aspect, the first adjustment pattern forming operation that forms one adjustment pattern of the first adjustment pattern Pb for adjusting the landing position of the liquid discharged from the discharging unit 4 in the first direction B or the second adjustment pattern Pa for adjusting the landing position of the liquid discharged from the discharging unit 4 in the second direction A on the recording medium P, the first adjustment pattern reading operation that reads the one adjustment pattern formed in the first adjustment pattern forming operation with the reading unit 16, the second adjustment pattern forming operation that forms the other adjustment pattern different to the adjustment pattern formed in the first adjustment pattern forming operation on the medium P, and the second adjustment pattern reading operation that reads the other adjustment pattern formed in the second adjustment pattern forming operation with the reading unit 16 are continuously executed. Therefore, it is possible to reduce the number of maintenance operations of the discharging unit 4 before and after forming and reading each pattern, compared to a case where first adjustment pattern forming operation, the second adjustment pattern forming operation, the first adjustment pattern reading operation, and the second adjustment pattern reading operation are executed with individual instructions. Accordingly, it is possible for the time for adjusting the position of the liquid landing on the medium P to be reduced.

The entire disclosure of Japanese Patent Application No. 2014-200980, filed Sep. 30, 2014 is expressly incorporated by reference herein.

What is claimed is:

1. A liquid discharging apparatus, comprising:

a discharging unit that includes a nozzle row that discharges a liquid, and that is able to reciprocate in a first direction that intersects the nozzle row;

a transport unit that transports a medium in a second direction that intersects the first direction; and a reading unit that reads a pattern formed by the liquid discharged from the discharging unit to the medium, wherein the liquid discharging apparatus is configured to be able to continuously execute a first adjustment pattern forming operation for forming an adjustment pattern for adjusting the landing position of the liquid discharged from the discharging unit in the second direction, a first adjustment pattern reading operation for reading the first adjustment pattern formed in the first adjustment pattern forming operation with the reading unit, a second adjustment pattern forming operation for forming a second adjustment pattern different to the adjustment pattern formed in the first adjustment pattern forming operation on the medium, and a second adjustment pattern reading operation for reading the second adjustment pattern formed in the second adjustment pattern forming operation with the reading unit.

2. The liquid discharging apparatus according to claim 1, wherein the second adjustment pattern is formed after adjustment according to reading results of the first adjustment pattern.

3. The liquid discharging apparatus according to claim 1, wherein, in the first and second adjustment pattern forming operations, the first adjustment pattern and the second adjustment pattern are formed lined up in the first direction.

4. The liquid discharging apparatus according to claim 1, wherein the second adjustment pattern is formed and the second adjustment pattern is read by the reading unit after the first adjustment pattern is formed and the first adjustment pattern is read by the reading unit.

5. The liquid discharging apparatus according to claim 4, wherein the medium is transported by a predetermined amount from forming the first adjustment pattern until the second adjustment pattern is formed.

6. The liquid discharging apparatus according to claim 1, wherein the first adjustment pattern is formed and the first adjustment pattern is read by the reading unit after the second adjustment pattern is formed and the second adjustment pattern is read by the reading unit.

7. The liquid discharging apparatus according to claim 1, further comprising:

an adjustment unit for adjusting the landing position of the liquid, based on the reading results of the first adjustment pattern and the second adjustment pattern by the reading unit.

8. The liquid discharging apparatus according to claim 1, wherein the first adjustment pattern is formed from a plurality of reference patterns, and has an adjustment pattern that is able to adjust the discharge timing of the liquid by the liquid being discharged with the discharge timing of the liquid shifted with respect to the plurality of reference patterns.

9. The liquid discharging apparatus according to claim 1, wherein the reading unit is able to read a plurality of locations corresponding to different regions from the nozzle row in the first adjustment pattern.

10. A liquid discharging apparatus, comprising, a discharging unit that includes a nozzle row that discharges a liquid, and that is able to reciprocate in a first direction that intersects the nozzle row;

a transport unit that transports a medium in a second direction that intersects the first direction; and a reading unit that reads a pattern formed by the liquid discharged from the discharging unit to the medium, wherein the liquid discharging apparatus is configured to be able to continuously execute:

a first adjustment pattern forming operation for forming an adjustment pattern of one of a first adjustment pattern for adjusting a landing position of the liquid discharged from the discharging unit in the first direction or a second adjustment pattern for adjusting the landing position of the liquid discharged from the discharging unit in the second direction is formed on the medium, a first adjustment pattern reading operation for reading the one adjustment pattern formed in the first adjustment pattern forming operation with the reading unit, a second adjustment pattern forming operation for forming the other adjustment pattern different to the adjustment pattern formed in the first adjustment pattern forming operation on the medium, and a second adjustment pattern reading operation for reading the other adjustment pattern formed in the second adjustment pattern forming operation with the reading unit;

wherein the reading unit is able to read a plurality of locations corresponding to different regions from the nozzle row in the first adjustment pattern;

wherein the nozzle row is able to discharge liquid droplets with different discharge amounts, and the first adjustment pattern is formed so that an outside region has droplets with a smaller discharge amount than the inside region among the different regions.

11. The liquid discharging apparatus according to claim 1, wherein the first adjustment pattern is formed by the discharging unit being reciprocated a plurality of times in the first direction.

12. A liquid discharge position adjustment method that is executable using a liquid discharging apparatus provided with a discharging unit that includes a nozzle row that discharges a liquid and that is able to reciprocate in a first direction that intersects the nozzle row, a transport unit that transports a medium in a second direction that intersects the first direction, and a reading unit that reads a pattern formed by the liquid discharged from the discharging unit to the medium, the method comprising:

continuously executing a first adjustment pattern forming operation for forming an adjustment pattern for adjusting the landing position of the liquid discharged from the discharging unit in the second direction, a first adjustment pattern reading operation for reading the first adjustment pattern formed in the first adjustment pattern forming operation with the reading unit, a second adjustment pattern forming operation for forming a second adjustment pattern different to the adjustment pattern formed in the first adjustment pattern forming operation on the medium, and a second adjustment pattern reading operation for reading the second adjustment pattern formed in the second adjustment pattern forming operation with the reading unit.

13. The liquid discharge apparatus of claim 1, wherein the second adjustment pattern is an adjustment patter for adjusting the landing position of the liquid discharged from the discharging unit in the first direction.

14. The liquid discharge position adjustment method of claim 12, wherein the second adjustment pattern is an adjustment patter for adjusting the landing position of the liquid discharged from the discharging unit in the first direction.

* * * * *